US007001699B2

(12) United States Patent
Tanaka et al.

(10) Patent No.: US 7,001,699 B2
(45) Date of Patent: Feb. 21, 2006

(54) ELECTROPHOTOGRAPHIC PHOTOSENSITIVE MEMBER, PROCESS CARTRIDGE AND ELECTROPHOTOGRAPHIC APPARATUS

(75) Inventors: Takakazu Tanaka, Shizuoka (JP); Akira Yoshida, Kanagawa (JP); Hidetoshi Hirano, Shizuoka (JP); Yuka Ishiduka, Shizuoka (JP); Harunobu Ogaki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 163 days.

(21) Appl. No.: 10/647,205

(22) Filed: Aug. 26, 2003

(65) Prior Publication Data

US 2004/0053150 A1 Mar. 18, 2004

(30) Foreign Application Priority Data

Aug. 30, 2002 (JP) ..... 2002-253617
Aug. 30, 2002 (JP) ..... 2002-253618

(51) Int. Cl.
*G03G 5/047* (2006.01)

(52) U.S. Cl. ..... 430/58.7; 430/58.05; 430/58.35; 430/58.15; 430/58.5; 430/58.6

(58) Field of Classification Search ..... 430/58.7, 430/58.05, 58.35, 58.15, 58.5, 58.6
See application file for complete search history.

(56) References Cited

U.S. PATENT DOCUMENTS

| | | | | |
|---|---|---|---|---|
| 4,680,373 | A * | 7/1987 | Gallagher et al. | 528/185 |
| 4,806,443 | A | 2/1989 | Yanus et al. | 430/56 |
| 5,116,708 | A | 5/1992 | Shikatani et al. | 430/59 |
| 5,654,119 | A | 8/1997 | Ishii et al. | 430/59 |
| 5,733,697 | A | 3/1998 | Endoh et al. | 430/59 |
| 5,804,343 | A * | 9/1998 | Umeda et al. | 430/58.2 |
| 6,258,499 | B1 | 7/2001 | Itami | 430/56 |
| 6,630,566 | B1 * | 10/2003 | Allen et al. | 528/422 |

FOREIGN PATENT DOCUMENTS

| | | |
|---|---|---|
| EP | 0699654 | 3/1996 |
| JP | 64-9964 | 1/1989 |
| JP | 2-282263 | 11/1990 |
| JP | 3-221522 | 9/1991 |
| JP | 8-208820 | 8/1996 |
| WO | WO 99/32537 | 7/1999 |

OTHER PUBLICATIONS

Peter Strohriegl et al., The Higher Homologues of Triphenylamine: Model Compounds for Poly(N-phenyl-1,4-phenyleneamine), *Makromol. Chem*, vol. 193, 1992, pp. 909-919.

* cited by examiner

*Primary Examiner*—John L Goodrow
(74) *Attorney, Agent, or Firm*—Fitzpatrick, Cella, Harper & Scinto

(57) ABSTRACT

In an electrophotographic photosensitive member having a support, and provided thereon a photosensitive layer, a surface layer of the electrophotographic photosensitive member contains an electrically insulating binder resin and a random-copolymer type high-molecular-weight charge-transporting material having two kinds of specific repeating structural units. Also disclosed are a process cartridge and an electrophotographic apparatus which have such an electrophotographic photosensitive member.

16 Claims, 1 Drawing Sheet

FIGURE
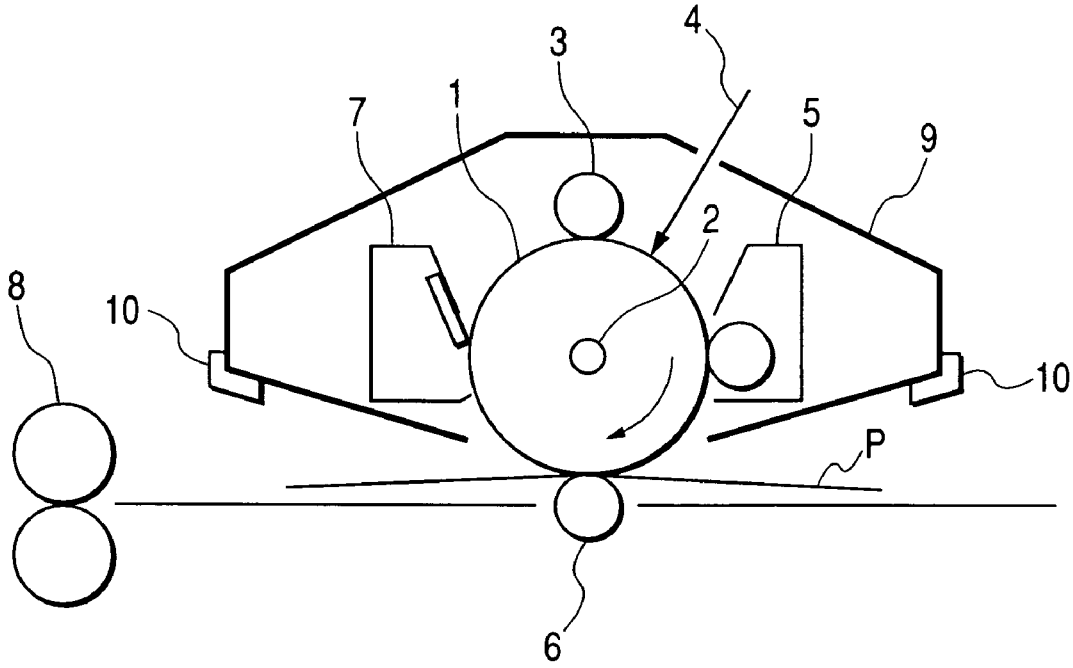

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

1. Field of the Invention

This invention relates to an electrophotographic photosensitive member, and a process cartridge and an electrophotographic apparatus which have the electrophotographic photosensitive member.

2. Related Background Art

In recent years, for the purpose of overcoming disadvantages of inorganic electrophotographic photosensitive members making use of inorganic photoconductive materials, organic electrophotographic photosensitive members making use of organic photoconductive materials have been energetically put forward. In order to satisfy both electrical properties and mechanical properties, organic electrophotographic photosensitive members are often provided with a photosensitive layer which is a multi layer type (function separated type) photosensitive layer in which a charge generation layer containing a charge generating material and a charge transport layer containing a charge transporting material are superposingly formed.

Electrophotographic photosensitive members are required to have a stated sensitivity, electrical properties and optical properties which have been adapted to electrophotographic processes applied. Electrophotographic photosensitive members are also required to have durability to electrical and mechanical external forces because such forces are directly applied thereto through corona charging or contact charging, imagewise exposure, development by toner, image transfer, surface cleaning and so forth.

As to methods for improving wear resistance of the surfaces of organic electrophotographic photosensitive members, there is known in the art a method in which the binder resin of a surface layer is made to have a high molecular weight, a method in which a filler is added to the binder resin of a surface layer, a method in which the structure of a binder resin is incorporated with a siloxane structure of a structure for imparting lubricity (slipperiness) such as a fluorine-containing substituent or a solid lubricant such as polytetrafluoroethylene (PTFE) is added so as to reduce the coefficient of friction with cleaning means such as a cleaning blade.

As another method for improving wear resistance of the surfaces of organic electrophotographic photosensitive members, it is proposed to use a binder resin having good mechanical strength.

However, even if the binder resin itself has good mechanical strength, its use in mixture with a low-molecular-weight charge-transporting material can not sufficiently make the most of the mechanical strength the binder resin has originally, and such a binder resin has not necessarily achieved satisfactory durability (wear resistance or scratch resistance). On the other hand, if the charge-transporting material is added in a smaller quantity in an attempt to make the most of the mechanical strength the binder resin has originally, a problem may arise such that it causes a lowering of electrophotographic sensitivity or a rise of residual potential. That is, this proposal has not achieved both the surface mechanical strength and the electrophotographic performance.

The method in which lubricity is imparted to the surfaces of electrophotographic photosensitive members to reduce the coefficient of friction with cleaning means such as a cleaning blade may also cause a lowering of the surface mechanical strength, and has not succeeded in achievement of sufficient durability.

The use of a high molecular weight charge transporting material for the purpose of better preventing the electrophotographic photosensitive member surface from having a low mechanical strength because of the addition of a low molecular weight charge transporting material is disclosed in Japanese Patent Applications Laid open No. 64-9964, No. 2-282263, No. 3-221522, No. 8-208820 and so forth. In many of these, however, it is not necessarily the case that the surfaces have sufficient wear resistance. Even in those having a mechanical strength to a certain extent, there has been a disadvantage that the manufacturing cost is too high to be suited for practical use.

SUMMARY OF THE INVENTION

An object of the present invention is to solve the above problems to provide an electrophotographic photosensitive member having high surface mechanical strength, having superior durability (wear resistance or scratch resistance) and also having stability in repeated use, and a process cartridge and an electrophotographic apparatus which have such an electrophotographic photosensitive member.

That is, the present invention is an electrophotographic photosensitive member comprising a support, and provided thereon is a photosensitive layer, wherein;

a surface layer of the electrophotographic photosensitive member contains:

an electrically insulating binder resin; and a random copolymer type high molecular weight charge transporting material having a repeating structural unit represented by the following Formula (11) and a repeating structural unit represented by the following Formula (12):

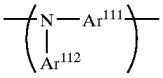

(11)

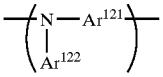

(12)

wherein $Ar^{111}$ and $Ar^{121}$ each independently represent a substituted or unsubstituted divalent aromatic hydrocarbon ring group other than a phenylene group, or a substituted or unsubstituted divalent aromatic heterocyclic ring group, and $Ar^{112}$ and $Ar^{122}$ each independently represent a substituted or unsubstituted monovalent aromatic hydrocarbon ring group or a substituted or unsubstituted monovalent aromatic heterocyclic ring group; provided that a case is excluded in which the repeating structural unit represented by Formula (11) and the repeating structural unit represented by Formula (12) are identical in structure.

The present invention is also a process cartridge and an electrophotographic apparatus which have the above electrophotographic photosensitive member.

BRIEF DESCRIPTION OF THE DRAWING

FIGURE is a schematic view showing an example of the construction of an electrophotographic apparatus provided with a process cartridge having the electrophotographic photosensitive member of the present invention.

DESCRIPTION OF THE PREFERRED EMBODIMENTS

The present invention is described below in detail.

The electrophotographic photosensitive member of the present invention has a support and a photosensitive layer provided on the support, and has a surface layer containing an electrically insulating binder resin and a specific high-molecular-weight charge-transporting material.

The surface layer contains as the high molecular weight charge transporting material a random copolymer type high molecular weight charge transporting material having a repeating structural unit represented by the above Formula (11) and a repeating structural unit represented by the above Formula (12). This random copolymer type high molecular weight charge transporting material is by no means limited to the copolymer or bipolymer, and may be incorporated with three or more repeating structural units as long as the effect of the present invention is not compromised. From the viewpoint that the effect of the present invention is not compromised and where the number of the repeating structural unit represented by the above Formula (11) is k, the number of the repeating structural unit represented by the above Formula (12) is m and the total number of repeating structural units the random copolymer type high molecular weight charge transporting material has is s, the value of (k+m)/s may preferably be in the range of from 0.5 to 1, more preferably from 0.75 to 1 and still more preferably 1. The value of k/m may also preferably be in the range of from 1 to 30.

In the present invention, the random copolymer is meant to be a copolymer obtained by, as shown in Synthesis Examples given later, introducing two or more kinds of monomer materials simultaneously in a reaction vessel at the time of synthesis reaction for the copolymer to allow them to react, without making any artificial control that may cause polymerization reaction having regularity as in the case of alternating copolymers or block copolymers (usually, polymeric products synthesized by such a synthesis method are considered to stand random copolymers). Thus, the random-copolymer type high-molecular-weight charge-transporting material is meant to be a high-molecular-weight charge-transporting material synthesized by the above synthesis method. For example, where the repeating structural units are represented by A and B, the random copolymer is a copolymer having irregular arrangement such as AAABAA, ABABBA or AABBABA. The alternating copolymer is a copolymer having regular arrangement, ABABAB. The block copolymer is a copolymer with variety in length for each repeating structural unit, such as AAABBB or AAAAABBBB, but with the respective repeating structural units present as blocks.

In the above Formulas (11) and (12), $Ar^{111}$ and $Ar^{121}$ each independently represent a substituted or unsubstituted divalent aromatic hydrocarbon ring group other than a phenylene group, or a substituted or unsubstituted divalent aromatic heterocyclic ring group; and $Ar^{112}$ and $Ar^{122}$ each independently represent a substituted or unsubstituted monovalent aromatic hydrocarbon ring group or a substituted or unsubstituted monovalent aromatic heterocyclic ring group; provided that a case is excluded in which the repeating structural unit represented by Formula (11) and the repeating structural unit represented by Formula (12) are identical in structure.

The $Ar^{111}$ in the repeating structural unit represented by Formula (11) and the $Ar^{121}$ in the repeating structural unit represented by Formula (12) may also each independently be a divalent group having structure represented by one Formula selected from the group consisting of the following Formulas (21) to (26).

(21)

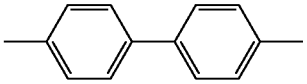

(22)

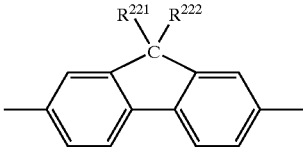

(23)

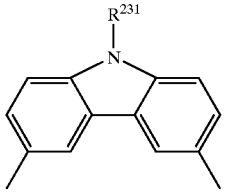

(24)

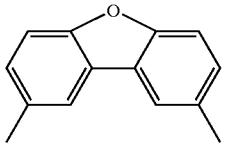

(25)

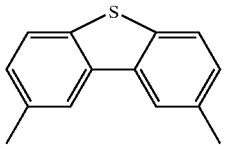

(26)

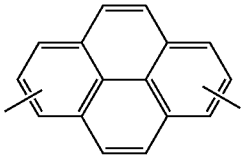

In Formula (22), $R^{221}$ and $R^{222}$ each independently represent a hydrogen atom, a substituted or unsubstituted alkyl group or a substituted or unsubstituted phenyl group. In Formula (23), $R^{231}$ represents a substituted or unsubstituted alkyl group or a substituted or unsubstituted phenyl group.

It is more preferable that the $Ar^{111}$ in Formula (11) is a divalent group having structure represented by the following Formula (21) and that the $Ar^{121}$ in Formula (12) is not a divalent group having structure represented by the following Formula (21). It is still more preferable that the $Ar^{121}$ in Formula (12) is a divalent group having structure represented by the following Formula (24) or (25).

(21)

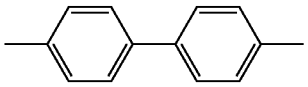

(24)

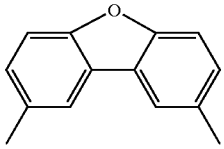

(25)

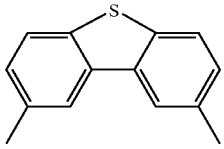

It is also more preferable that the $Ar^{111}$ in Formula (11) and the $Ar^{121}$ in Formula (12) are divalent groups which are identical in structure, that the $Ar^{112}$ in Formula (11) and the $Ar^{122}$ in Formula (12) are monovalent groups which are different in structure from each other, that at least one of $Ar^{112}$ and $Ar^{122}$ has an electron attractive group and also that the $Ar^{111}$ in Formula (11) and the $Ar^{121}$ in Formula (12) are divalent groups having structure represented by the following Formula (21).

(21)

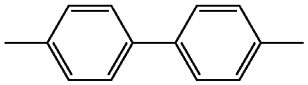

Where in the random-copolymer type high-molecular-weight charge-transporting material the number of side chains having no electron attractive group is represented by B and the number of side chains having electron attractive groups by A, the value of B/A may preferably be in the range of from 2 to 40.

The above monovalent aromatic hydrocarbon ring group may include monovalent groups such as naphthalene, anthracene, perylene, fluorene, biphenyl and terphenyl from which one hydrogen atom has been removed. The above monovalent aromatic heterocyclic ring group may include monovalent groups such as carbazole, furan, benzofuran, thiophene, benzothiophene, quinoline, phenazine, dibenzothiophene, dibenzofuran and carbazole from which one hydrogen atom has been removed.

The above divalent aromatic hydrocarbon ring group may include divalent groups such as naphthalene, anthracene, perylene, fluorene, biphenyl and terphenyl from which two hydrogen atoms have been removed. The above divalent aromatic heterocyclic ring group may include divalent groups such as carbazole, furan, benzofuran, thiophene, benzothiophene, quinoline, phenazine, dibenzothiophene, dibenzofuran and carbazole from which two hydrogen atoms have been removed.

The above alkyl group may include a methyl group and an ethyl group.

The substituents of each of the above groups may include alkyl groups such as a methyl group, an ethyl group, a propyl group and a butyl group; alkoxyl groups such as a methoxyl group, an ethoxyl group and a propoxyl group; aiyloxyl groups such as a phenoxyl group and a naphthoxyl group; halogen atoms such as a fluorine atom, a chlorine atom and a bromine atom; and di substituted amino groups such as a dimethylamino group, a diethylamino group and a diphenylamino group.

The electron attractive group may include halogen atoms such as a fluorine atom and a chlorine atom, and fluorine atom substituted alkyl groups such as a trifluoromethyl group, as well as a cyano group and a nitro group.

The electron attractive group may include halogen atoms such as a fluorine atom and a chlorine atom, and fluorine-atom-substituted alkyl groups such as a trifluoromethyl group, as well as a cyano group and a nitro group.

The random-copolymer type high-molecular-weight charge-transporting material used in the present invention may also preferably have a weight-average molecular weight Mw of 1,500 or more, and on the other hand 9,000 or less, more preferably 5,000 or less, and still more preferably 3,000 or less.

Examples of the repeating structural units constituting the random-copolymer type high-molecular-weight charge-transporting materials of the present invention are shown below. The present invention is by no means limited to these.

(CT-1)

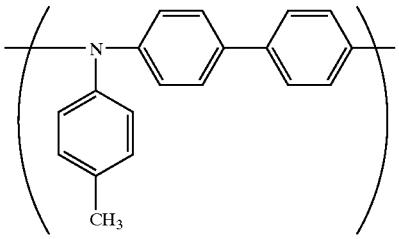

(CT-2)

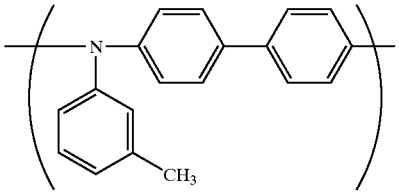

(CT-3)

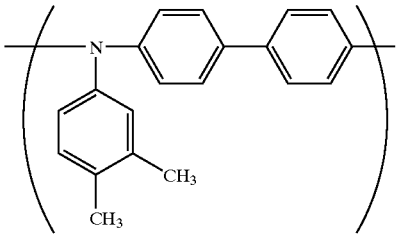

(CT-4)

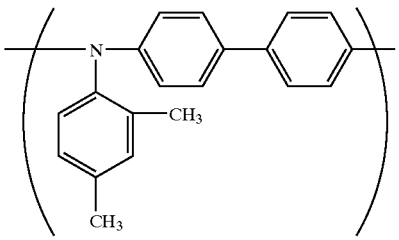

-continued
(CT-5)
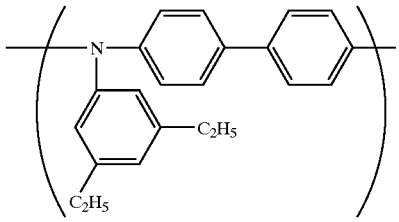
(CT-6)
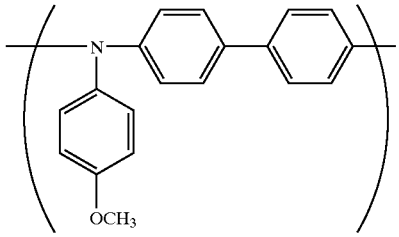
(CT-7)
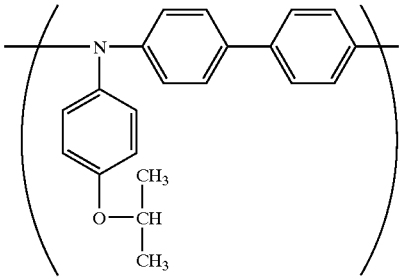
(CT-8)
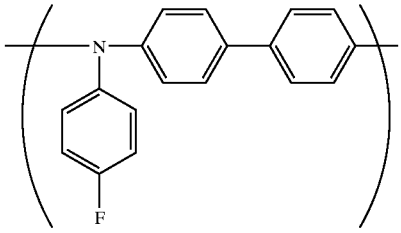
(CT-9)
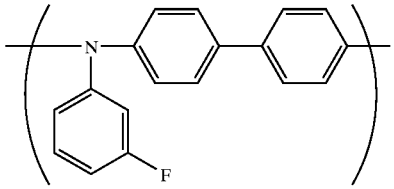
(CT-10)
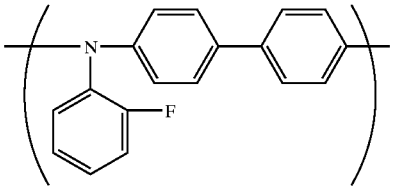
-continued
(CT-11)
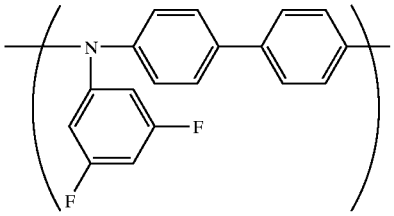
(CT-12)
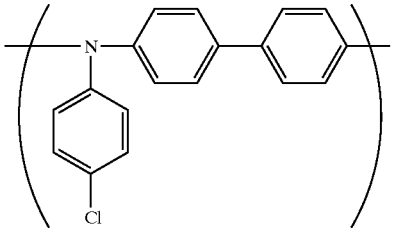
(CT-13)
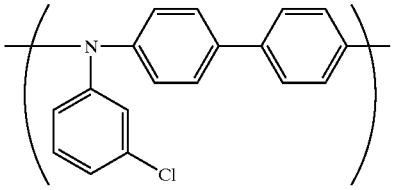
(CT-14)
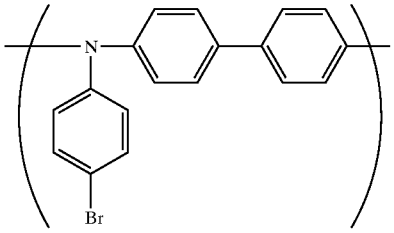
(CT-15)
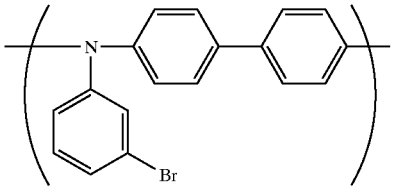
(CT-16)
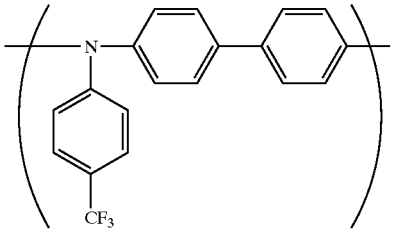
(CT-17)
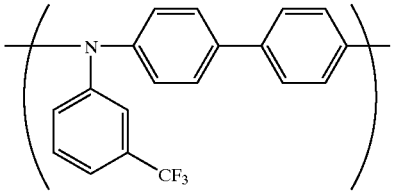

-continued
(CT-18)
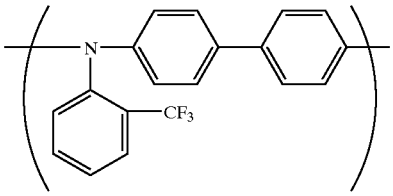
(CT-19)
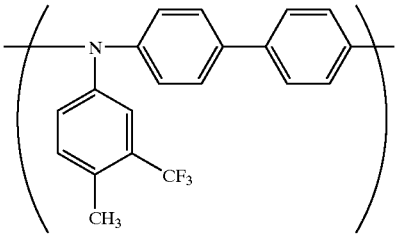
(CT-20)
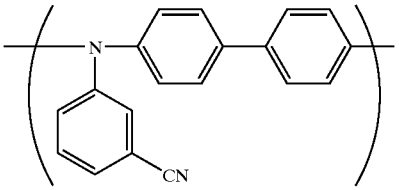
(CT-21)
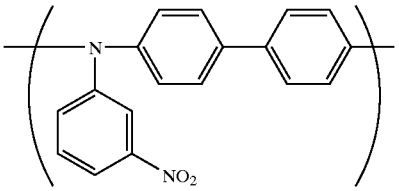
(CT-22)
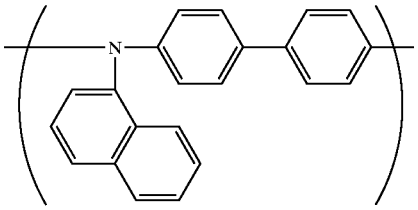
(CT-23)
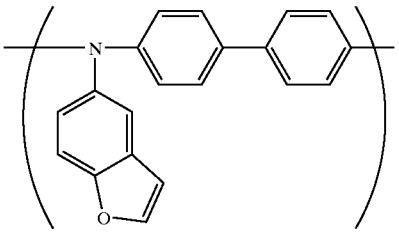
(CT-24)
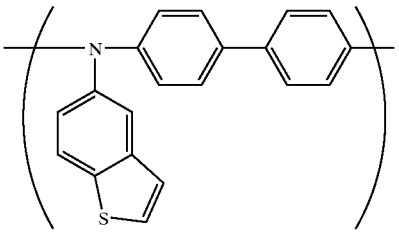
-continued
(CT-25)
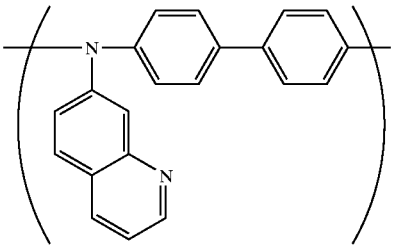
(CT-26)
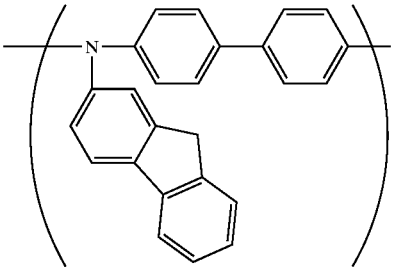
(CT-27)
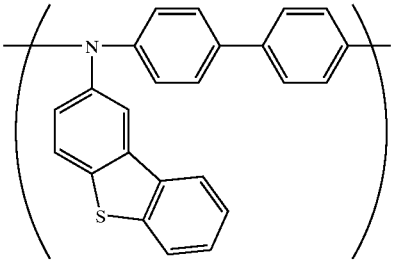
(CT-28)
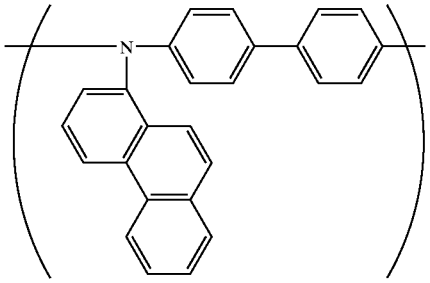
(CT-29)
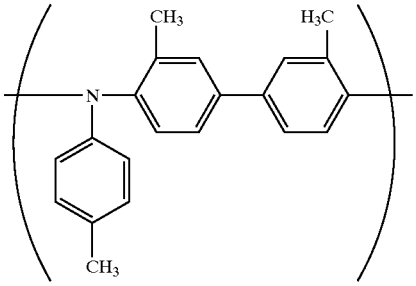

-continued
(CT-30)
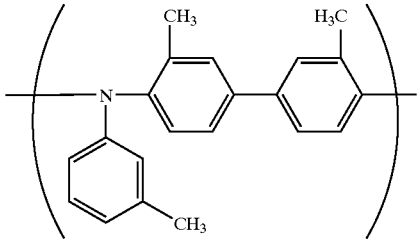
(CT-31)
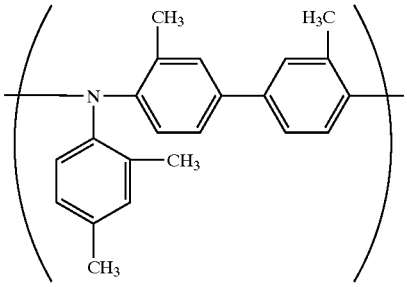
(CT-32)
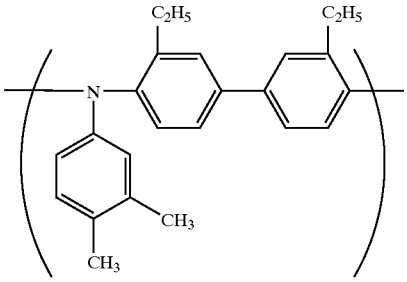
(CT-33)
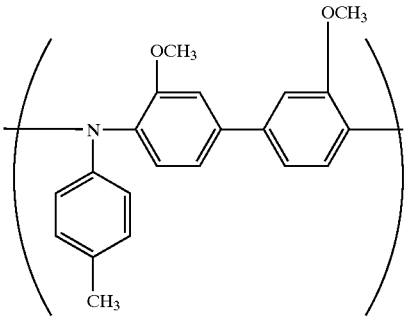
(CT-34)
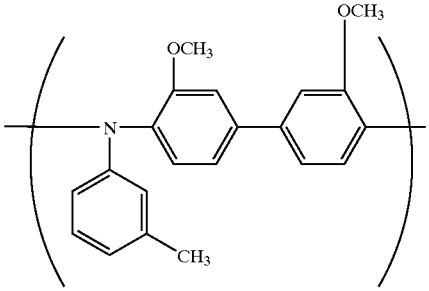
-continued
(CT-35)
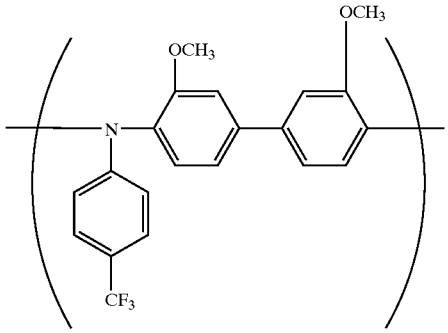
(CT-36)
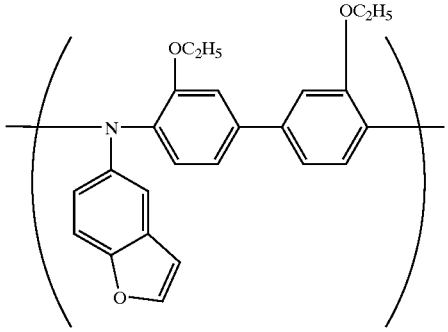
(CT-37)
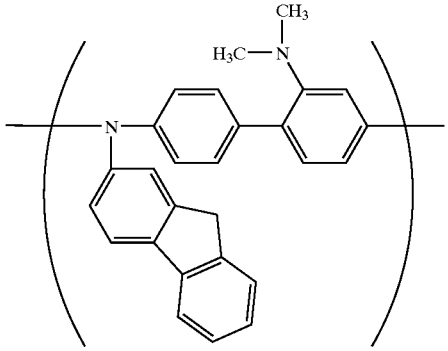
(CT-38)
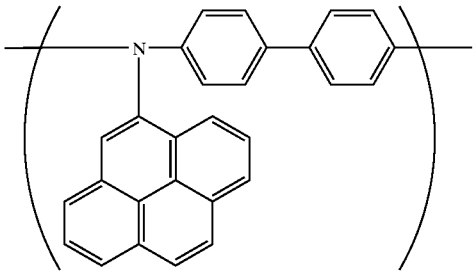
(CT-39)
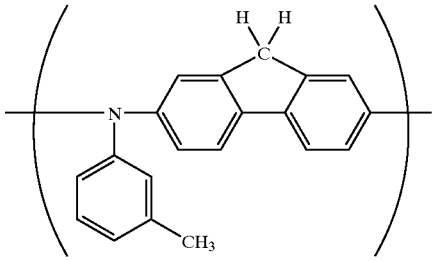

-continued
(CT-40)
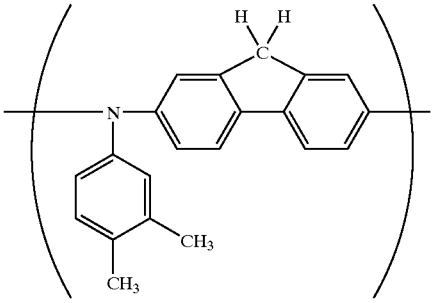
(CT-41)
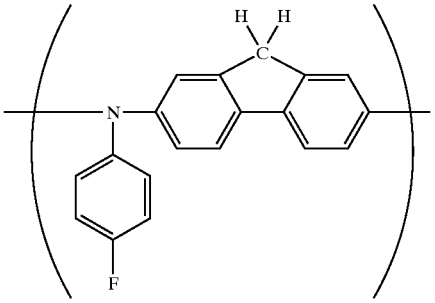
(CT-42)
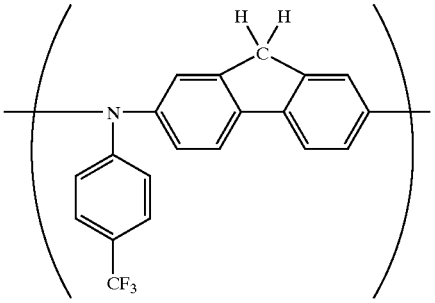
(CT-43)
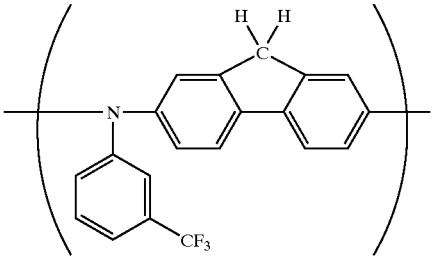
(CT-44)
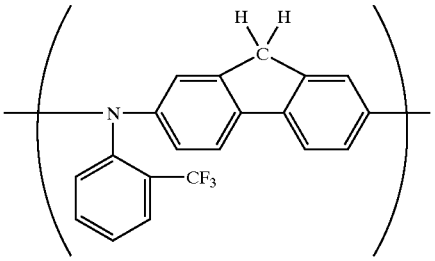
-continued
(CT-45)
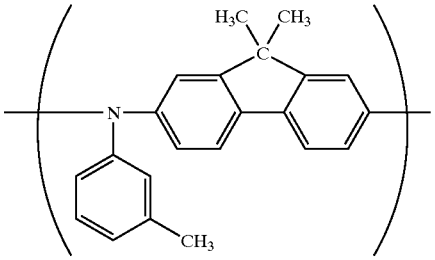
(CT-46)
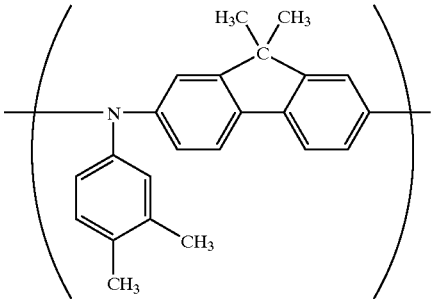
(CT-47)
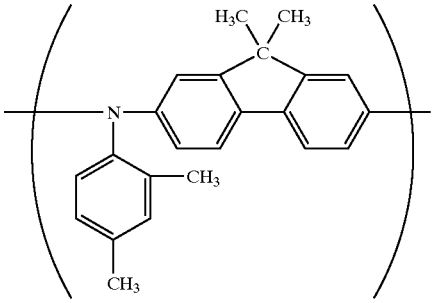
(CT-48)
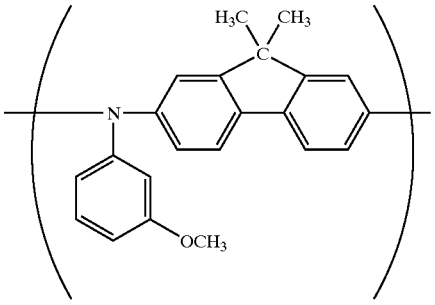
(CT-49)
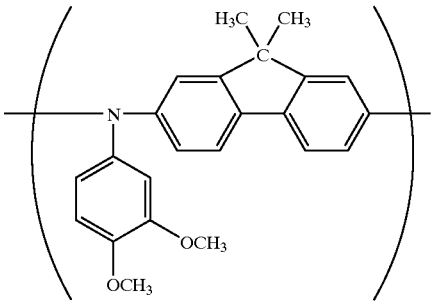

-continued
(CT-50)
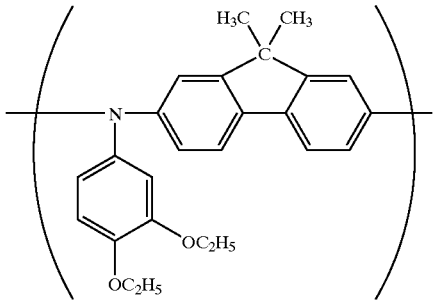
(CT-51)
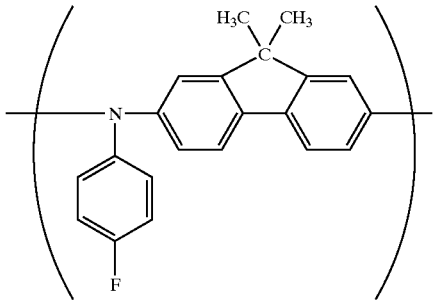
(CT-52)
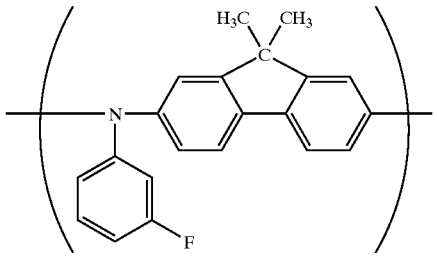
(CT-53)
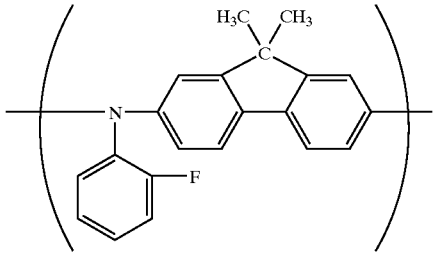
(CT-54)
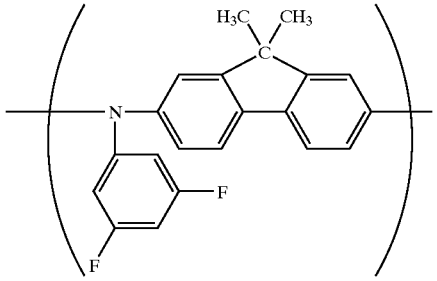
-continued
(CT-55)
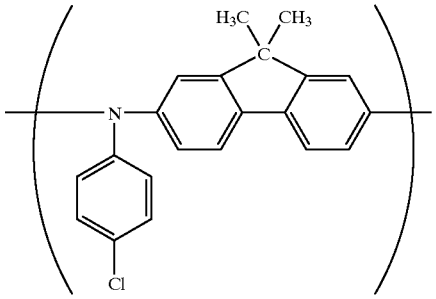
(CT-56)
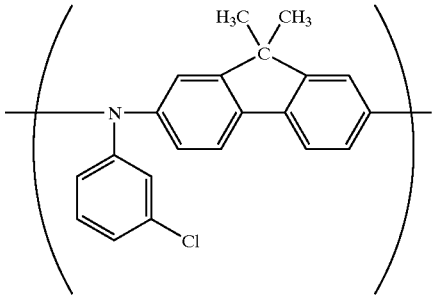
(CT-57)
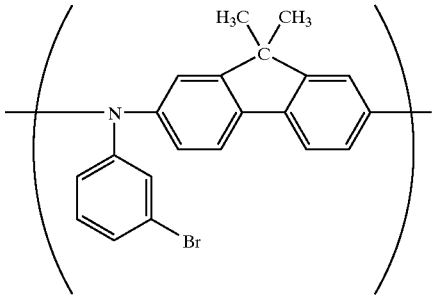
(CT-58)
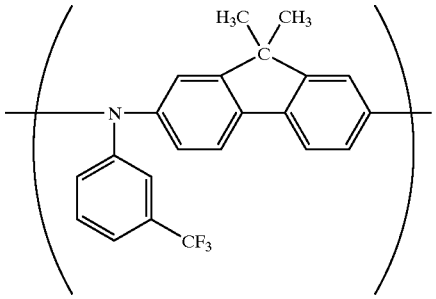
(CT-59)
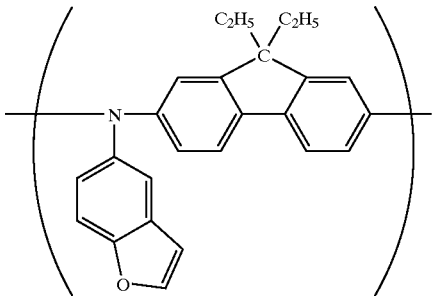

-continued
(CT-60)
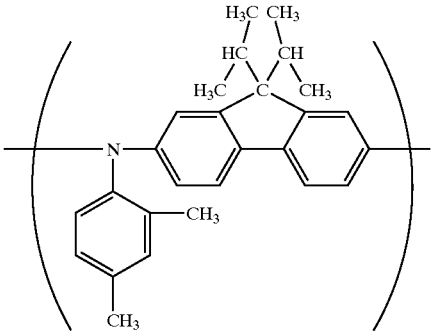
(CT-61)
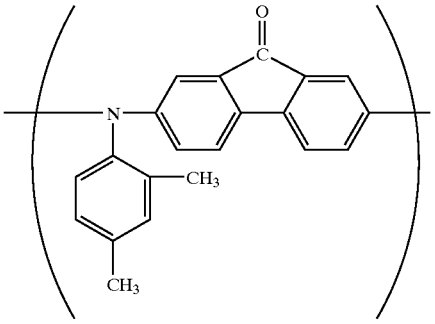
(CT-62)
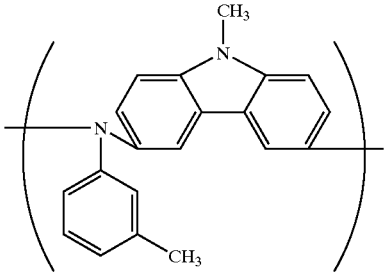
(CT-63)
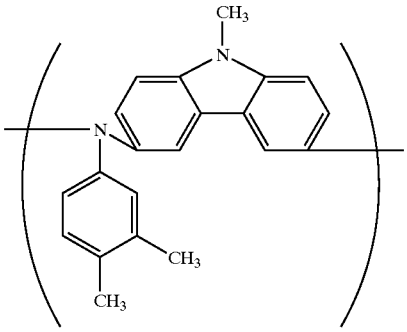
(CT-64)
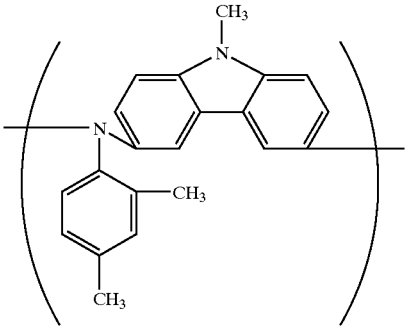
-continued
(CT-65)
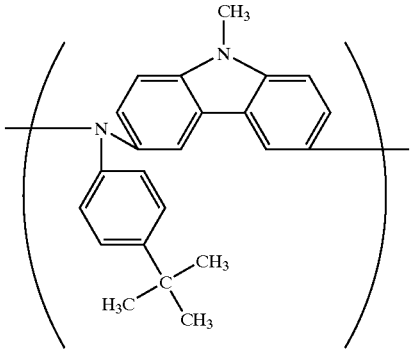
(CT-66)
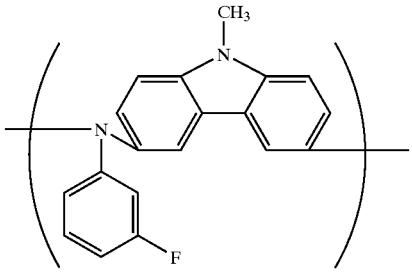
(CT-67)
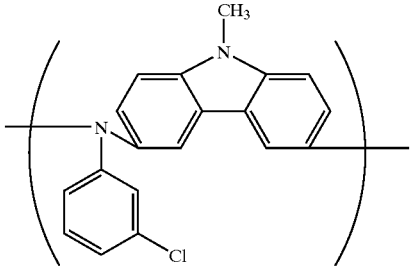
(CT-68)
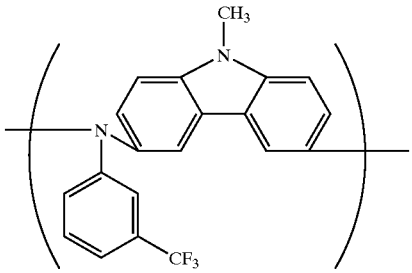
(CT-69)
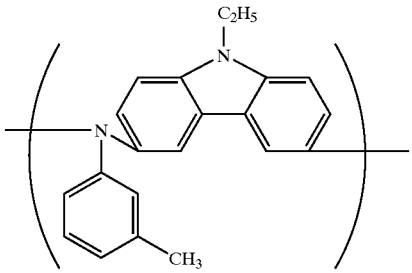

-continued
(CT-70)
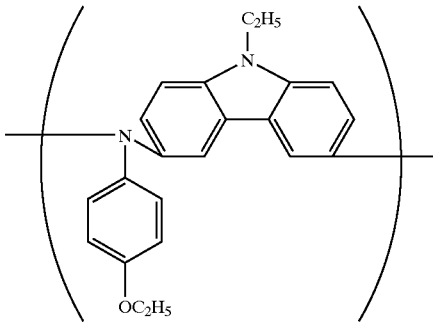
(CT-71)
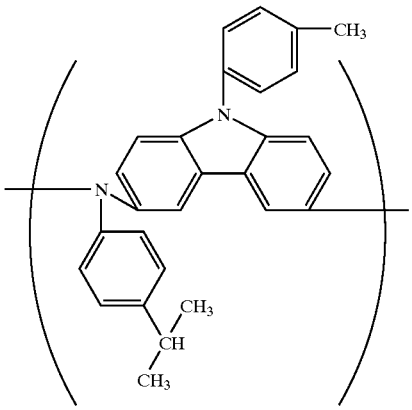
(CT-72)
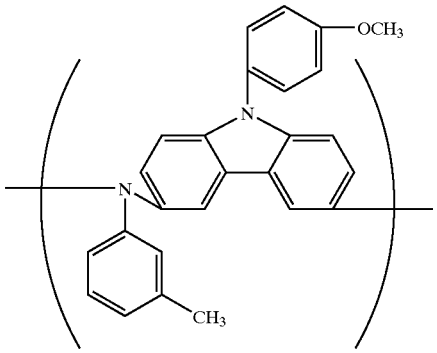
(CT-73)
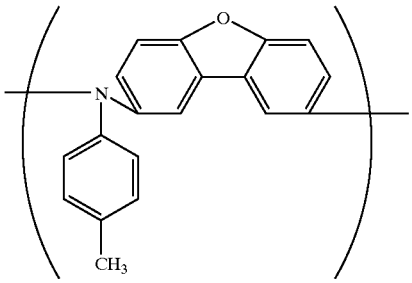
-continued
(CT-74)
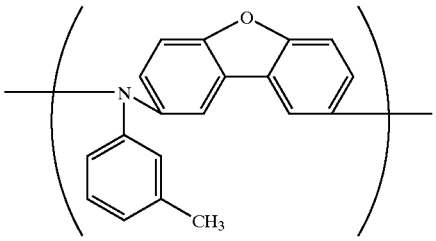
(CT-75)
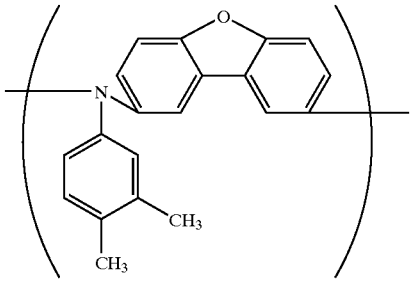
(CT-76)
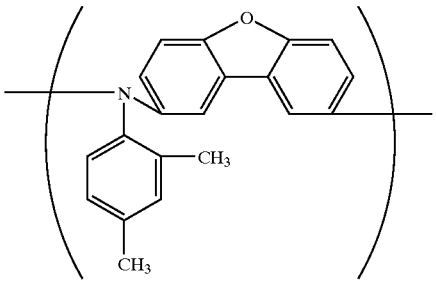
(CT-77)
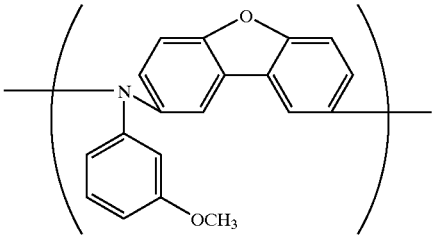
(CT-78)
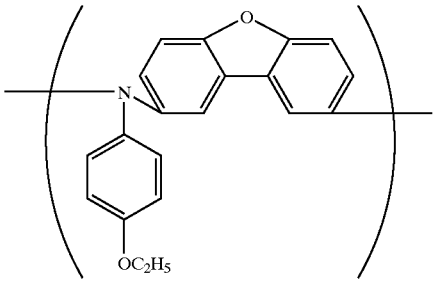
(CT-79)
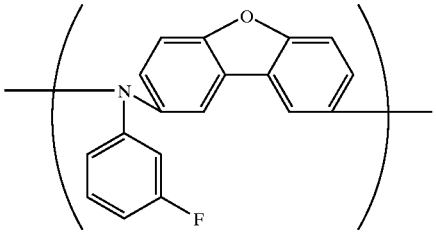

-continued
(CT-80)
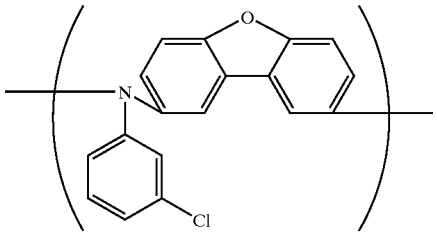
(CT-81)
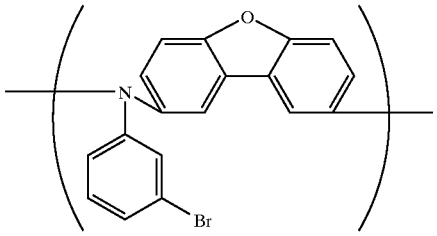
(CT-82)
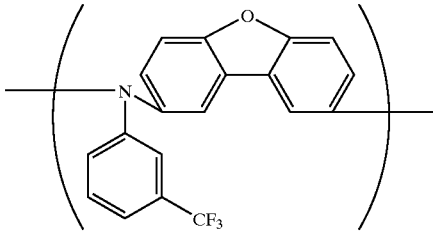
(CT-83)
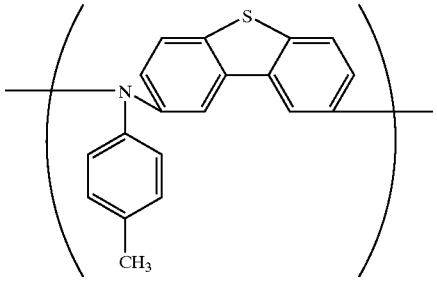
(CT-84)
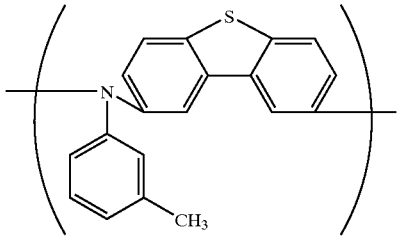
(CT-85)
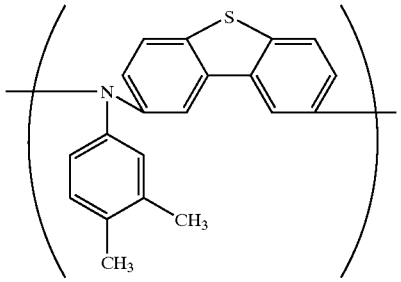
-continued
(CT-86)
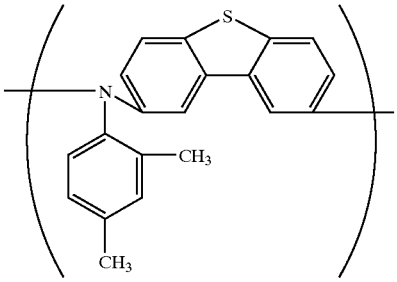
(CT-87)
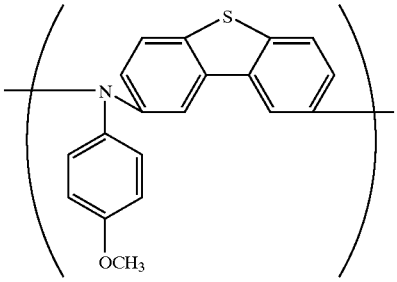
(CT-88)
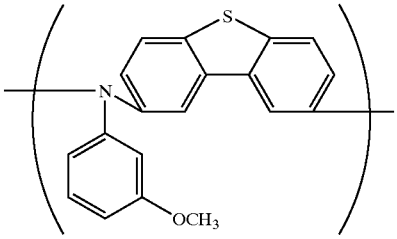
(CT-89)
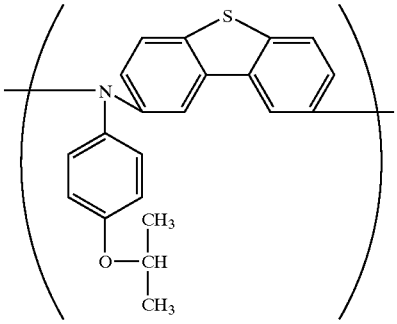
(CT-90)
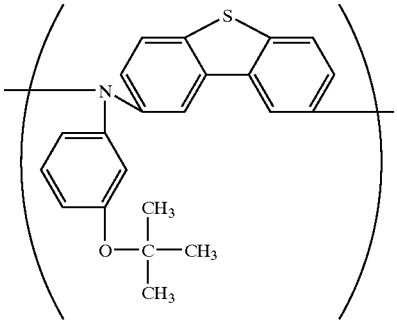

-continued (CT-91)

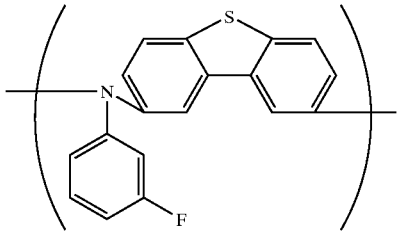

(CT-92)

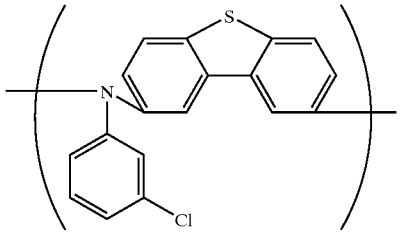

(CT-93)

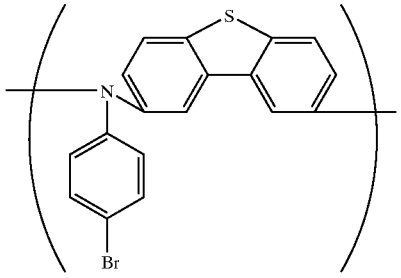

(CT-94)

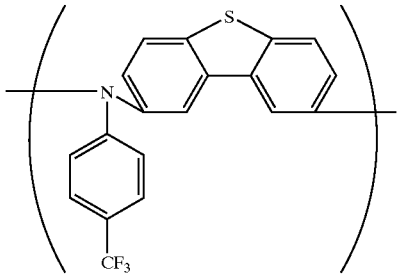

Structural examples of the random-copolymer type high-molecular-weight charge-transporting material used in the present invention are shown in Tables 1 and 2 below. The present invention is by no means limited to these.

TABLE 1

| Structure | Repeating structural units (1) | (2) | (3) |
|---|---|---|---|
| CTP-1 | CT-2 | CT-45 | — |
| CTP-2 | CT-2 | CT-64 | — |
| CTP-3 | CT-2 | CT-74 | — |
| CTP-4 | CT-2 | CT-84 | — |
| CTP-5 | CT-2 | CT-84 | — |
| CTP-6 | CT-4 | CT-46 | — |
| CTP-7 | CT-4 | CT-61 | — |
| CTP-8 | CT-4 | CT-76 | — |
| CTP-9 | CT-4 | CT-86 | — |
| CTP-10 | CT-5 | CT-69 | — |
| CTP-11 | CT-24 | CT-73 | — |
| CTP-12 | CT-27 | CT-91 | — |
| CTP-13 | CT-48 | CT-77 | — |

TABLE 1-continued

| Structure | Repeating structural units (1) | (2) | (3) |
|---|---|---|---|
| CTP-14 | CT-61 | CT-83 | — |
| CTP-15 | CT-76 | CT-86 | — |
| CTP-16 | CT-79 | CT-91 | — |
| CTP-17 | CT-2 | CT-9 | CT-76 |
| CTP-18 | CT-2 | CT-59 | CT-90 |
| CTP-19 | CT-4 | CT-69 | CT-74 |
| CTP-20 | CT-4 | CT-70 | CT-92 |

TABLE 2

| Structure | Repeating structural units (1) | (2) | (3) |
|---|---|---|---|
| CTP-21 | CT-2 | CT-17 | — |
| CTP-22 | CT-2 | CT-16 | — |
| CTP-23 | CT-2 | CT-9 | — |
| CTP-24 | CT-2 | CT-13 | — |
| CTP-25 | CT-4 | CT-17 | — |
| CTP-26 | CT-4 | CT-8 | — |
| CTP-27 | CT-4 | CT-15 | — |
| CTP-28 | CT-6 | CT-20 | — |
| CTP-29 | CT-24 | CT-13 | — |
| CTP-30 | CT-29 | CT-9 | — |
| CTP-31 | CT-39 | CT-43 | — |
| CTP-32 | CT-45 | CT-52 | — |
| CTP-33 | CT-45 | CT-56 | — |
| CTP-34 | CT-45 | CT-57 | — |
| CTP-35 | CT-2 | CT-16 | CT-48 |
| CTP-36 | CT-2 | CT-11 | CT-60 |
| CTP-37 | CT-4 | CT-13 | CT-52 |
| CTP-38 | CT-4 | CT-12 | CT-49 |

Of these, CTP-3, CTP-4, CTP-8, CTP-9, CTP-23, CTP-25, CTP-26, CTP-32 and CTP-33 are preferred, and CTP-8, CTP-9, CTP-23 and CTP-32 are more preferred.

The charge-transporting material incorporated in the surface layer of the electrophotographic photosensitive member of the present invention has a high molecular weight. Hence, it can prevent the surface layer from having a low film strength because of the addition of a charge-transporting material and can provide superior scratch resistance and wear resistance.

In addition, the charge-transporting material incorporated in the surface layer of the electrophotographic photosensitive member of the present invention is the copolymer having two or more kinds of repeating structural units. Hence, compared with homopolymers having single repeating structural units, the lowering of ionization potential of the charge-transporting material can be kept low, and the material can be tough even to the oxidation due to discharge and so forth and can be almost free of its deterioration due to repeated use. It has such characteristic features.

The random-copolymer type high-molecular-weight charge-transporting material used in the present invention also has an advantage that it enables easy control of solubility in solvents and compatibility with binder resins, compared with alternating copolymer type and block copolymer type ones.

Only one kind of the random-copolymer type high-molecular-weight charge-transporting material described above or two or more kinds thereof may be used in the surface layer of the electrophotographic photosensitive member of the present invention.

The electrophotographic photosensitive member of the present invention is constructed as described below.

The electrophotographic photosensitive member of the present invention has the photosensitive layer on the support.

The photosensitive layer of the electrophotographic photosensitive member of the present invention may be either of a single-layer type photosensitive layer, in which a charge-generating material and a charge-transporting material are contained in the same layer, and a multi-layer type, which is functionally separated into a charge generation layer containing a charge-generating material and a charge transport layer containing a charge-transporting material. In view of electrophotographic performance, the multi-layer type is preferred.

The support may be any of those having a conductivity (conductive support), and may include supports made of metal such as aluminum or stainless steel, and supports made of metal, paper or plastic on which a layer providing conductivity is formed. As the shape of the support, it may be in the shape of a cylinder, a belt or the like.

Where laser light is used in imagewise exposure, a conductive layer may be provided on the support for the purpose of preventing interference fringes due to light scattering or for the purpose of covering any scratches of the support. The conductive layer may be formed of a binder resin in which conductive particles such as carbon black and metal particles have been dispersed. The conductive layer may preferably have a layer thickness of from 5 μm to 40 μm, and particularly more preferably from 10 μm to 30 μm. Incidentally, the interference fringes may also be prevented by treating the surface of the support by cutting, anodizing, dry-process blasting, wet-process blasting or the like.

Between the support or conductive layer and the photosensitive layer, an intermediate layer may also be provided which has the function of bonding or the function as a barrier. To form the intermediate layer, a resin such as polyamide, polyvinyl alcohol, polyethylene oxide, ethyl cellulose, casein, polyurethane or polyether-urethane may be dissolved in a suitable solvent, and the resulting solution may be coated on the support or conductive layer, followed by drying. The intermediate layer may preferably have a layer thickness of from 0.05 μm to 5 μm, and particularly more preferably from 0.3 μm to 1 μm.

On the support, conductive layer or intermediate layer, the photosensitive layer is provided.

The multi-layer type photosensitive layer, which is functionally separated into a charge generation layer containing a charge-generating material and a charge transport layer containing a charge-transporting material, is described first.

The charge-generating material may include selenium-tellurium dyes, pyrylium dyes, thiapyrylium dyes, phthalocyanine pigments, anthanthrone pigments, dibenspirenequinone pigments, trisazo pigments, cyanine pigments, azo (trisazo, disazo and monoazo) pigments, indigo pigments, quinacridone pigments and asymmetric quinocyanine pigments.

To form the charge generation layer, the charge-generating material may be well dispersed together with a 0.3 to 4-fold quantity of binder resin and a suitable solvent by means of a homogenizer, an ultrasonic dispersion machine, a ball mill, a vibrating ball mill, a sand mill, an attritor, a roll mill, a liquid impact type high-speed dispersion machine or the like, and the dispersion obtained may be coated, followed by drying. Incidentally, the binder resin may be introduced after the charge-generating material has been dispersed, or the binder resin may be not used if the charge-generating material has film-forming properties. The charge generation layer may preferably have a layer thickness of 5 μm or less, and particularly more preferably from 0.1 μm to 2 μm.

Where the charge transport layer is the surface layer of the electrophotographic photosensitive member, the charge-transporting material used in such a charge transport layer is the above random-copolymer type high-molecular-weight charge-transporting material of the present invention.

To form the surface layer charge transport layer, the random-copolymer type high-molecular-weight charge-transporting material and the electrically insulating binder resin may be dissolved with a solvent, and the coating solution obtained may be coated, followed by drying. The charge transport layer may preferably have a layer thickness of from 5 μm to 40 μm, more preferably from 10 μm to 35 μms, and still more preferably from 15 μm to 30 μm.

The random-copolymer type high-molecular-weight charge-transporting material and the electrically insulating binder resin may preferably be in a weight ratio of from 2:1 to 1:10, more preferably from 1:1 to 1:8, and still more preferably from 1:2 to 1:4.

The electrically insulating binder resin may be any of electrically insulating binder resins commonly used in electrophotographic photosensitive members. In particular, polycarbonate resins and polyarylate resins are especially favorable in order to bring out the effect of the present invention.

The polycarbonate resins and the polyarylate resins are both obtainable by conventional methods. In particular, a polycarbonate resin obtained by polycondensation using bisphenol and phosgene and a polyarylate resin obtained by polycondensation using bisphenol and a dicarboxylic-acid chloride are preferred because electrophotographic performance such as sensitivity can be improved in view of purity as being, e.g., residue-free and also because mechanical properties such as mechanical strength can be improved in view of molecular weight and molecular weight distribution.

The polycarbonate resin may preferably have a weight-average molecular weight Mw in the range of from 40,000 to 200,000, and the polyarylate resin may preferably have a weight-average molecular weight Mw in the range of from 40,000 to 200,000.

A low molecular weight charge transporting material may also be used in combination as long as the effect of the present invention is not compromised. From the viewpoint that the effect of the present invention is not compromised, structures having charge transport performance of the random copolymer type high molecular weight charge transporting material (e.g., the repeating structural unit represented by the above Formula (11) and the repeating structural units represented by the above Formula (12)) may preferably be in a proportion of 50 mol % or more, and still more preferably 70 mol % or more, based on the whole structures having charge transport performance (i.e., the sum of the repeating structural units and the low molecular weight charge transporting material). The low molecular weight charge transporting material may include, e.g., triarylamine compounds, hydrazone compounds, stilbene compounds, pyrazoline compounds, oxazole compounds, triallylmethane compounds and thiazole compounds.

Where the photosensitive layer is the single-layer type photosensitive layer and the single-layer type photosensitive layer is the surface layer of the electrophotographic photosensitive member, the single-layer type photosensitive layer may be formed by dissolving or dispersing the charge-generating material, the random-copolymer type high-molecular-weight charge-transporting material and so forth in the electrically insulating binder resin, and coating the resulting dispersion, followed by drying. The single-layer type photosensitive layer may preferably have a layer thickness of from 5 μm to 40 μm, and more preferably from 15 μm to 30 μm.

For the purpose of protecting the photosensitive layer, a protective layer may also be provided on the photosensitive layer, and this may be made to serve as the surface layer.

The protective layer serving as the surface layer of the electrophotographic photosensitive member may be formed by dissolving the random-copolymer type high-molecular-weight charge-transporting material and the electrically insulating binder resin in a suitable solvent, and coating the resulting coating solution on the photosensitive layer, followed by drying. The protective layer may preferably have a layer thickness of from 0.05 μm to 20 μm.

A lubricant for providing lubricity (slipperiness) or a filler for improving mechanical strength may also be added to the surface layer of the electrophotographic photosensitive member of the present invention.

When the above respective layers are formed, they may be formed by any coating method including dip coating, spray coating, spinner coating, blade coating and roll coating.

In the present invention, the weight-average molecular weight Mw is measured in the following way.

Measurement of Weight-Average Molecular Weight Mw:

The weight-average molecular weight is measured by a conventional method, using a gel permeation chromatography (GPC) apparatus (trade name: HLC8120GPC; manufactured by Tosoh Corporation).

A measurement target sample is put in THF (tetrahydrofuran), and is left to stand for several hours, followed by thorough shaking so as to be well mixed with the THF (until coalescent matter of the sample has disappeared), which is further left to stand for at least 12 hours. Thereafter, the solution having been passed through a sample-treating filter (trade name: MAISHORIDISK H-25-5; available from Tosoh Corporation; pore size: 0.45 to 0.5 μm) is used as the sample for GPC. The sample is so prepared that the measurement target sample is in a concentration of from 0.5 to 5 mg/ml.

Using the sample for GPC thus prepared, the weight-average molecular weight of the measurement target sample is measured in the following way.

Columns are stabilized in a heat chamber of 40° C. To the columns kept at this temperature, THF as a solvent is flowed at a flow rate of 1 ml per minute, and about 10 μl of the sample for GPC is injected thereinto to make measurement.

In measuring the molecular weight of the measurement target sample, the molecular weight distribution the measurement target sample has is calculated from the relationship between the logarithmic value of a calibration curve prepared using several kinds of monodisperse polystyrene standard samples and the count number.

As the standard polystyrene samples used for preparing the calibration curve, 10 standard polystyrene samples with molecular weights of from $10^2$ to $10^7$ are used, which are available from Tosoh Corporation.

An RI (refractive index) detector is used as a detector.

As the columns, TSKgel series are used, which are available from Tosoh Corporation.

FIGURE schematically illustrates the construction of an electrophotographic apparatus provided with a process cartridge having the electrophotographic photosensitive member of the present invention.

In FIGURE, reference numeral 1 denotes a drum-shaped electrophotographic photosensitive member of the present invention, which is rotatingly driven around an axis 2 in the direction of an arrow at a stated peripheral speed.

The electrophotographic photosensitive member 1 is, being rotatingly driven, uniformly electrostatically charged on its peripheral surface to a positive or negative, given potential through a charging means (primary charging means) 3. The electrophotographic photosensitive member thus charged is then exposed to exposure light (imagewise exposure light) 4 emitted from an exposure means (not shown) for slit exposure or laser beam scanning exposure. In this way, electrostatic latent images corresponding to the intended image information are successively formed on the peripheral surface of the electrophotographic photosensitive member 1.

The electrostatic latent images thus formed on the peripheral surface of the electrophotographic photosensitive member 1 are developed with toner by the operation of a developing means 5. The toner images thus formed and held on the peripheral surface of the electrophotographic photosensitive member 1 are then successively transferred by the aid of transfer bias applied from a transfer means (transfer roller) 6, to a transfer material (such as paper) P taken out and fed from a transfer material feed means (not shown) to the part (contact part) between the electrophotographic photosensitive member 1 and the transfer means 6 in the manner synchronized with the rotation of the electrophotographic photosensitive member 1.

The transfer material P onto which the toner images have been transferred is separated from the peripheral surface of the electrophotographic photosensitive member, is led through a fixing means 8, where the toner images are fixed, and is then put out of the apparatus as an image-formed material (a print or copy).

The peripheral surface of the electrophotographic photosensitive member 1 from which images have been transferred is brought to removal of transfer residual toner through a cleaning means (cleaning blade) 7. Thus, its surface is cleaned. The electrophotographic photosensitive member is further subjected to charge elimination by pre-exposure light (not shown) emitted from a pre-exposure means (not shown), and then repeatedly used for the formation of images. Incidentally, where the charging means 3 is a contact charging means making use of a charging roller or the like as shown in FIGURE, the pre-exposure is not necessarily required.

The apparatus may be constituted of a combination of plural components integrally joined in a container as a process cartridge from among the constituents such as the above electrophotographic photosensitive member 1, charging means 3, developing means 5, transfer means 6 and cleaning means 7 so that the process cartridge is detachably mountable to the main body of an electrophotographic apparatus such as a copying machine or a laser beam printer. In the apparatus shown in FIGURE, the electrophotographic photosensitive member 1, the primary charging means 3, the developing means 5 and the cleaning means 7 are integrally supported in a cartridge to form a process cartridge 9 that is detachably mountable to the main body of the electrophotographic apparatus through a guide means 10 such as rails provided in the main body of the electrophotographic apparatus.

The effect of the present invention comes out remarkably in a system having a high process speed (135 mm/s or more; the operating speed of the above process in which the electrophotographic photosensitive member is charged, the electrostatic latent image is formed by exposure and developed with a toner, the toner image formed is transferred to paper or the like and thereafter the electrophotographic photosensitive member surface is cleaned), and a system making use of a cleaning blade as the cleaning means.

The present invention is described below in greater detail by giving Examples.

SYNTHESIS EXAMPLE 1

3.6 g of N,N'-di(3-methylphenyl)benzidine, 1.56 g of 2,7-dibromobiphenyl and 1.7 g of 2,8-dibromodibenzothiophene were dissolved in 20 ml of dry o-xylene, followed by addition of 10 mg of palladium acetate, 55 mg of 2-(di-tert-butylphospheno)biphenyl and 1.34 g of tert-butoxysodium to effect heating and reflux for 4 hours, and further followed by addition of 0.5 g of 4-bromotoluene to effect heating and reflux for 2 hours.

The resulting reaction mixture was left to cool, from which the catalyst was removed thereafter, and then poured into acetone to obtain a yellow solid.

The solid thus obtained was further again dissolved in toluene, and subjected to treatment with activated carbon, column chromatography and reprecipitation to effect purification, to obtain 3.5 g of a pale yellow solid.

This pale yellow solid was the random-copolymer type high-molecular-weight charge-transporting material CTP-1, having CT-2 to CT-45 compositional ratio (molar ratio) of 50:50.

SYNTHESIS EXAMPLE 2

3.6 g of N,N'-di(3-methylphenyl)benzidine, 3.25 g of 2,7-diiodobiphenyl and 0.84 g of 2,8-diiododibenzofuran were dissolved in 10 ml of o-dichlorobenzene, followed by addition of 3.1 g of copper powder and 3.8 g of potassium carbonate to effect heating and reflux for 8 hours.

The resulting reaction mixture was left to cool, from which the catalyst was removed thereafter, and then poured into acetone to obtain a yellow solid.

The solid thus obtained was further again dissolved in toluene, and subjected to treatment with activated carbon, column chromatography and reprecipitation to effect purification, to obtain 3.2 g of a pale yellow solid.

This pale yellow solid was the random-copolymer type high-molecular-weight charge-transporting material CTP-3, having CT-2 to CT-74 compositional ratio (molar ratio) of 80:20.

SYNTHESIS EXAMPLE 3

2.03 g of 2,7-dibromobiphenyl, 1.20 g of 2,8-dibromodibenzothiophene and 1.1 g of m-toluidine were dissolved in 20 ml of dry o-xylene, followed by addition of 10 mg of palladium acetate, 55 mg of 2-(di-tert-butylphospheno)biphenyl and 1.30 g of tert-butoxysodium to effect heating and reflux for 6 hours, and further followed by addition of 0.5 g of 4-bromotoluene to effect heating and reflux for 2 hours.

The resulting reaction mixture was left to cool, from which the catalyst was removed thereafter, and then poured into acetone to obtain a yellow solid.

The solid thus obtained was further again dissolved in toluene, and was subjected to treatment with activated carbon, column chromatography and reprecipitation to effect purification, to obtain 3.6 g of a pale yellow solid.

This pale yellow solid was the random-copolymer type high-molecular-weight charge-transporting material CTP-4, having CT-2 to CT-84 compositional ratio (molar ratio) of 65:35.

SYNTHESIS EXAMPLE 4

3.92 g of N,N'-di(1,4-dimethylphenyl)benzidine, 4.72 g of N,N'-di(3-trifluoromethylphenyl)benzidine and 8.12 g of 2,7-diiodobiphenyl were dissolved in 10 ml of o-dichlorobenzene, followed by addition of 6.4 g of copper powder and 5.5 g of potassium carbonate to effect heating and reflux for 8 hours.

The resulting reaction mixture was left to cool, from which the catalyst was removed thereafter, and then poured into acetone to obtain a yellow solid.

The solid thus obtained was further again dissolved in toluene, and subjected to treatment with activated carbon, column chromatography and reprecipitation to effect purification, to obtain 6.5 g of a pale yellow solid.

This pale yellow solid was the random-copolymer type high-molecular-weight charge-transporting material CTP-21, having CT-2 to CT-17 compositional ratio (molar ratio) of 50:50.

Other random-copolymer type high-molecular-weight charge-transporting materials are also obtainable in the same way as in Synthesis Examples 1 to 4.

In the following Examples, "part(s)" refers to "part(s) by weight".

EXAMPLE 1

An aluminum cylinder of 30 mm in diameter and 357.5 mm in length was used as the support. This support was dip-coated thereon with a conductive layer forming coating dispersion made up of the following materials, followed by heat curing at 140° for 30 minutes to form a conductive layer with a layer thickness of 15 $\mu$m.

| | |
|---|---|
| Conductive pigment: $SnO_2$-coated barium sulfate | 10 parts |
| Resistance-adjusting pigment: Titanium oxide | 2 parts |
| Binder resin: Phenol resin | 6 parts |
| Leveling agent: Silicone oil | 0.001 part |
| Solvent: Methanol/methoxypropanol = 2/8 | 20 parts |

Next, 3 parts of N-methoxymethylated nylon and 3 parts of copolymer nylon were dissolved in a mixed solvent of 65 parts of methanol and 30 parts of n-butanol to prepare a solution, and this was dip-coated on the conductive layer, followed by drying to form an intermediate layer with a layer thickness of 0.5 $\mu$m.

Next, 4 parts of hydroxygallium phthalocyanine crystals of a crystal form having strong peaks at Bragg's angles ($2\theta \pm 0.2°$) of 7.3° and 28.1° in the CuK$\alpha$ characteristic X-ray diffraction, 2 parts of polyvinyl butyral resin (trade name: S-LEC BX-1; available from Sekisui Chemical Co., Ltd.) and 60 parts of cyclohexanone were subjected to dispersion for 4 hours by means of a sand mill making use of glass beads of 1 mm in diameter, followed by addition of 100 parts of ethyl acetate to prepare a charge generation layer coating dispersion. This charge generation layer coating dispersion was dip-coated on the intermediate layer, followed by drying at 100° C. for 10 minutes to form a charge generation layer with a layer thickness of 0.3 $\mu$m.

Next, 4 parts of the random-copolymer type high-molecular-weight charge-transporting material CTP-1 obtained in Synthesis Example 1 and 10 parts of polycarbonate resin (trade name: IUPILON Z-400; available from Mitsubishi Engineering Co., Ltd.) were dissolved in a mixed solvent of 80 parts of monochlorobenzene and 20 parts of dichloromehtane to prepare a charge transport layer coating solution. This charge transport layer coating solution was dip-coated on the charge generation layer, followed by drying at 120° C. for 1 hour to form a charge transport layer with a layer thickness of 25 μm.

Thus, an electrophotographic photosensitive member was produced whose charge transport layer was the surface layer.

Next, the electrophotographic photosensitive member produced was evaluated as described below.

An evaluation apparatus is a remodeled machine of a laser beam printer LBP-950 (process speed: 144.5 mm/s), manufactured by CANON INC., having construction as shown in FIGURE. Its charging means is a contact charging means making use of a charging roller. A DC voltage on which an AC voltage has been superimposed is applied to the charging roller. This has been so remodeled that the control of charging is changed from constant-current control to constant-voltage control, and also the peak-to-peak voltage of AC voltage is set higher by 30%.

The electrophotographic photosensitive member produced was set in this evaluation apparatus. In an environment of high temperature and high humidity (H/H: 28° C., 90% RH), a paper feed running test was conducted. As its sequence, an intermittent mode was set up in which the printing was posed once for each sheet. When the toner runned up, it was replenished to continue the running test until any problem arose on images.

The surface of the electrophotographic photosensitive member was also made to wear for 18 hours by means of a Taber abrader making use of a polishing tape, to measure weight loss upon abrasion (Taber-volume loss).

Part of the electrophotographic photosensitive member surface was also irradiated by light of a white fluorescent lamp of 3,000 lux for 15 minutes, where this was left for 5 minutes and thereafter its light-area potential was measured to measure the extent to which the light-area potential lowered from the time before the irradiation by light. The measured value was regarded as the value of photomemory.

To further examine solvent cracking proofness, finger sebum was made to adhere to the electrophotographic photosensitive member surface. This was left for 80 hours, and then whether or not solvent cracking occurred was observed by microscopic observation.

The results of evaluation are shown in Table 5.

EXAMPLES 2 to 38

Electrophotographic photosensitive members were produced in the same manner as in Example 1 except that the random-copolymer type high-molecular-weight charge-transporting material used therein in the charge transport layer was changed for those having the structure, compositional ratio and weight-average molecular weight as shown in Tables 3 and 4. Evaluation was made in the same way.

The results of evaluation are shown in Tables 5 and 6.

TABLE 3

| | Random-copolymer type high-molecular-weight charge-transporting material | | | | | |
|---|---|---|---|---|---|---|
| | Struc- | Repeating structural unit | | | Compositional ratio (molar ratio) | Weight = average molecular weight |
| Example: | ture | (1) | (2) | (3) | (1)/(2)/(3) | (Mw) |
| 1 | CTP-1 | CT-2 | CT-45 | — | 50/50/— | 3,800 |
| 2 | CTP-2 | CT-2 | CT-64 | — | 70/30/— | 4,300 |
| 3 | CTP-3 | CT-2 | CT-74 | — | 80/20/— | 4,200 |
| 4 | CTP-4 | CT-2 | CT-84 | — | 65/35/— | 4,000 |
| 5 | CTP-5 | CT-2 | CT-84 | — | 90/10/— | 5,200 |

TABLE 3-continued

| | Random-copolymer type high-molecular-weight charge-transporting material | | | | | |
|---|---|---|---|---|---|---|
| | Struc- | Repeating structural unit | | | Compositional ratio (molar ratio) | Weight = average molecular weight |
| Example: | ture | (1) | (2) | (3) | (1)/(2)/(3) | (Mw) |
| 6 | CTP-6 | CT-4 | CT-46 | — | 70/30/— | 3,600 |
| 7 | CTP-7 | CT-4 | CT-61 | — | 70/30/— | 2,900 |
| 8 | CTP-8 | CT-4 | CT-76 | — | 80/20/— | 3,500 |
| 9 | CTP-9 | CT-4 | CT-86 | — | 80/20/— | 4,000 |
| 10 | CTP-10 | CT-5 | CT-69 | — | 60/40/— | 2,600 |
| 11 | CTP-11 | CT-24 | CT-73 | — | 50/50/— | 3,500 |
| 12 | CTP-12 | CT-27 | CT-91 | — | 70/30/— | 3,600 |
| 13 | CTP-13 | CT-48 | CT-77 | — | 80/20/— | 4,500 |
| 14 | CTP-14 | CT-61 | CT-83 | — | 90/10/— | 4,300 |
| 15 | CTP-15 | CT-76 | CT-86 | — | 60/40/— | 4,400 |
| 16 | CTP-16 | CT-79 | CT-91 | — | 50/50/— | 3,200 |
| 17 | CTP-17 | CT-2 | CT-9 | CT-76 | 60/30/10 | 3,600 |
| 18 | CTP-18 | CT-2 | CT-59 | CT-90 | 70/20/10 | 3,700 |
| 19 | CTP-19 | CT-4 | CT-69 | CT-74 | 80/10/10 | 3,600 |
| 20 | CTP-20 | CT-4 | CT-70 | CT-92 | 50/40/10 | 4,000 |

TABLE 4

| | Random-copolymer type high-molecular-weight charge-transporting material | | | | | |
|---|---|---|---|---|---|---|
| | Struc- | Repeating structural unit | | | Compositional ratio (molar ratio) | Weight = average molecular weight |
| Example: | ture | (1) | (2) | (3) | (1)/(2)/(3) | (Mw) |
| 21 | CTP-21 | CT-2 | CT-17 | — | 50/50/— | 3,600 |
| 22 | CTP-22 | CT-2 | CT-16 | — | 70/30/— | 4,200 |
| 23 | CTP-23 | CT-2 | CT-9 | — | 80/20/— | 4,200 |
| 24 | CTP-24 | CT-2 | CT-13 | — | 65/35/— | 4,000 |
| 25 | CTP-25 | CT-4 | CT-17 | — | 90/10/— | 4,300 |
| 26 | CTP-26 | CT-4 | CT-8 | — | 80/20/— | 3,600 |
| 27 | CTP-27 | CT-4 | CT-15 | — | 70/30/— | 2,900 |
| 28 | CTP-28 | CT-6 | CT-20 | — | 95/5/— | 3,500 |
| 29 | CTP-29 | CT-24 | CT-13 | — | 85/15/— | 4,100 |
| 30 | CTP-30 | CT-29 | CT-9 | — | 60/40/— | 2,800 |
| 31 | CTP-31 | CT-39 | CT-43 | — | 90/10/— | 3,500 |
| 32 | CTP-32 | CT-45 | CT-52 | — | 70/30/— | 3,600 |
| 33 | CTP-33 | CT-45 | CT-56 | — | 80/20/— | 4,500 |
| 34 | CTP-34 | CT-45 | CT-57 | — | 90/10/— | 4,300 |
| 35 | CTP-35 | CT-2 | CT-16 | CT-48 | 70/20/10 | 3,800 |
| 36 | CTP-36 | CT-2 | CT-11 | CT-60 | 70/20/10 | 3,700 |
| 37 | CTP-37 | CT-4 | CT-13 | CT-52 | 80/10/10 | 3,600 |
| 38 | CTP-38 | CT-4 | CT-12 | CT-49 | 50/40/10 | 4,000 |

TABLE 5

| Example: | Running limit value in H/H Fog occurred on: | Taber = volume loss | Photo-memory | Solvent cracking |
|---|---|---|---|---|
| 1 | 45,000th sheet. | 2.7 mg | 15 | Unseen. |
| 2 | 43,000th sheet. | 2.8 mg | 15 | Unseen. |
| 3 | 48,000th sheet. | 2.6 mg | 20 | Unseen. |
| 4 | 49,000th sheet. | 2.7 mg | 15 | Unseen. |
| 5 | 47,000th sheet. | 2.9 mg | 20 | Unseen. |
| 6 | 46,000th sheet. | 2.6 mg | 15 | Unseen. |
| 7 | 46,000th sheet. | 2.4 mg | 20 | Unseen. |
| 8 | 51,000th sheet. | 2.6 mg | 20 | Unseen. |
| 9 | 52,000th sheet. | 2.7 mg | 20 | Unseen. |

TABLE 5-continued

| Example: | Running limit value in H/H Fog occurred on: | Taber = volume loss | Photo-memory | Solvent cracking |
|---|---|---|---|---|
| 10 | 47,000th sheet. | 2.5 mg | 15 | Unseen. |
| 11 | 47,000th sheet. | 2.8 mg | 20 | Unseen. |
| 12 | 46,000th sheet. | 2.6 mg | 15 | Unseen. |
| 13 | 45,000th sheet. | 2.7 mg | 20 | Unseen. |
| 14 | 45,000th sheet. | 2.8 mg | 20 | Unseen. |
| 15 | 46,000th sheet. | 3.0 mg | 15 | Unseen. |
| 16 | 45,000th sheet. | 2.8 mg | 20 | Unseen. |
| 17 | 46,000th sheet. | 2.6 mg | 15 | Unseen. |
| 18 | 45,000th sheet. | 2.6 mg | 20 | Unseen. |
| 19 | 45,000th sheet. | 2.8 mg | 15 | Unseen. |
| 20 | 46,000th sheet. | 2.9 mg | 20 | Unseen. |

TABLE 6

| Example: | Running limit value in H/H Fog occurred on: | Taber = volume loss | Photo-memory | Solvent cracking |
|---|---|---|---|---|
| 21 | 47,000th sheet. | 2.6 mg | 15 | Unseen. |
| 22 | 45,000th sheet. | 2.8 mg | 15 | Unseen. |
| 23 | 52,000th sheet. | 2.7 mg | 15 | Unseen. |
| 24 | 45,000th sheet. | 2.7 mg | 15 | Unseen. |
| 25 | 49,000th sheet. | 2.7 mg | 20 | Unseen. |
| 26 | 48,000th sheet. | 2.6 mg | 15 | Unseen. |
| 27 | 46,000th sheet. | 2.5 mg | 25 | Unseen. |
| 28 | 47,000th sheet. | 2.5 mg | 20 | Unseen. |
| 29 | 46,000th sheet. | 2.7 mg | 25 | Unseen. |
| 30 | 46,000th sheet. | 2.5 mg | 15 | Unseen. |
| 31 | 47,000th sheet. | 2.7 mg | 20 | Unseen. |
| 32 | 52,000th sheet. | 2.6 mg | 15 | Unseen. |
| 33 | 48,000th sheet. | 2.6 mg | 20 | Unseen. |
| 34 | 45,000th sheet. | 2.7 mg | 15 | Unseen. |
| 35 | 46,000th sheet. | 2.6 mg | 15 | Unseen. |
| 36 | 47,000th sheet. | 2.6 mg | 15 | Unseen. |
| 37 | 46,000th sheet. | 2.7 mg | 15 | Unseen. |
| 38 | 44,000th sheet. | 2.9 mg | 20 | Unseen. |

COMPARATIVE EXAMPLE 1

An electrophotographic photosensitive member was produced in the same manner as in Example 1 except that the random-copolymer type high-molecular-weight charge-transporting material used therein in the charge transport layer was changed for a compound having structure represented by the following formula. Evaluation was made in the same way.

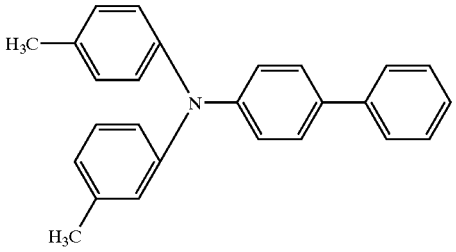

COMPARATIVE EXAMPLE 2

An electrophotographic photosensitive member was produced in the same manner as in Example 1 except that the random-copolymer type high-molecular-weight charge-transporting material used therein in the charge transport layer was changed for a homopolymer having the repeating structural unit represented by Formula CT-2 (weight-average molecular weight Mw: 4,000). Evaluation was made in the same way.

COMPARATIVE EXAMPLE 3

An electrophotographic photosensitive member was produced in the same manner as in Example 1 except that the random-copolymer type high-molecular-weight charge-transporting material used therein in the charge transport layer was changed for a homopolymer having the repeating structural unit represented by Formula CT-39 (weight-average molecular weight Mw: 3,200). Evaluation was made in the same way.

COMPARATIVE EXAMPLE 4

An electrophotographic photosensitive member was produced in the same manner as in Example 1 except that the random-copolymer type high-molecular-weight charge-transporting material used therein in the charge transport layer was changed for an alternating copolymer having the repeating structural unit represented by Formula CT-45 and the repeating structural unit represented by Formula CT-84 (weight-average molecular weight Mw: 3,500; copolymerization ratio 50:50). Evaluation was made in the same way.

COMPARATIVE EXAMPLE 5

An electrophotographic photosensitive member was produced in the same manner as in Example 2 except that the random-copolymer type high-molecular-weight charge-transporting material used therein in the charge transport layer was changed for a block copolymer obtained by block-copolymerizing the same material in the same composition (weight-average molecular weight Mw: 4,100). Evaluation was made in the same way.

The results of evaluation of Comparative Examples 1 to 5 are shown in Table 7.

TABLE 7

| Comparative Example: | Running limit value in H/H | Taber = volume loss | Photo-memory | Solvent cracking |
|---|---|---|---|---|
| 1 | Low density from the beginning. Fog occurred on 23,000th sheet. | 4.2 mg | 80 | Seen. |
| 2 | Smeared images appeared on 1,000th sheet. | 2.8 mg | 35 | Seen. |
| 3 | Smeared images appeared on 2,000th sheet. | 2.9 mg | 35 | Seen. |
| 4 | Fog occurred on 40,000th sheet. | 2.7 mg | 25 | Seen. |
| 5 | Fog occurred on 26,000th sheet. | 3.5 mg | 20 | Seen. |

EXAMPLES 39 TO 44

Electrophotographic photosensitive members were produced in the same manner as in Examples 1 to 3 and 21 to 23, respectively, except that the random-copolymer type high-molecular-weight charge-transporting materials used therein in the charge transport layers were each changed to have the weight-average molecular weight shown in Table 8. Evaluation was made in the same way.

The results of evaluation are shown in Table 9.

TABLE 8

| Example: | Random-copolymer type high-molecular-weight charge-transporting material: Structure | Repeating structural unit (1) | (2) | (3) | Compositional ratio (molar ratio) (1)/(2)/(3) | Weight = average molecular weight (Mw) |
|---|---|---|---|---|---|---|
| 39 | CTP-1 | CT-2 | CT-45 | — | 50/50/— | 1,200 |
| 40 | CTP-2 | CT-2 | CT-64 | — | 70/30/— | 800 |
| 41 | CTP-3 | CT-2 | CT-74 | — | 80/20/— | 600 |
| 42 | CTP-21 | CT-2 | CT-17 | — | 50/50/— | 1,200 |
| 43 | CTP-22 | CT-2 | CT-16 | — | 70/30/— | 800 |
| 44 | CTP-23 | CT-2 | CT-9 | — | 80/20/— | 600 |

TABLE 9

| Example: | Running limit value in H/H Fog occurred on: | Taber = volume loss | Photo-memory | Solvent cracking |
|---|---|---|---|---|
| 39 | 31,000th sheet. | 3.1 mg | 15 | Unseen. |
| 40 | 28,000th sheet. | 3.4 mg | 15 | Unseen. |
| 41 | 26,000th sheet. | 3.5 mg | 20 | Unseen. |
| 42 | 31,000th sheet. | 3.1 mg | 15 | Unseen. |
| 43 | 28,000th sheet. | 3.4 mg | 15 | Unseen. |
| 44 | 26,000th sheet. | 3.5 mg | 20 | Unseen. |

EXAMPLES 45 TO 52

Electrophotographic photosensitive members were produced in the same manner as in Examples 1, 2, 21 and 22, respectively, except that the binder resins used therein in the charge transport layers were each changed as shown in Table 10. Evaluation was made in the same way.

The results of evaluation are shown in Table 11.

TABLE 10

| Example: | Random-copolymer type high-molecular-weight charge-transporting material: Structure | Repeating structural unit (1) | (2) | Compositional ratio (molar ratio) (1)/(2) | Weight-average molecular weight (Mw) | Binder resin: Structure | Weight-average molecular weight (Mw) |
|---|---|---|---|---|---|---|---|
| 45 | CTP-1 | CT-2 | CT-45 | 50/50 | 3,800 | B-1 | 100,000 |
| 46 | CTP-2 | CT-2 | CT-64 | 70/30 | 4,300 | B-1 | 100,000 |
| 47 | CTP-1 | CT-2 | CT-45 | 50/50 | 3,800 | B-2 | 130,000 |
| 48 | CTP-2 | CT-2 | CT-64 | 70/30 | 4,300 | B-2 | 130,000 |
| 49 | CTP-21 | CT-2 | CT-17 | 50/50 | 3,600 | B-1 | 100,000 |
| 50 | CTP-22 | CT-2 | CT-16 | 70/30 | 4,200 | B-1 | 100,000 |
| 51 | CTP-21 | CT-2 | CT-17 | 50/50 | 3,600 | B-2 | 130,000 |
| 52 | CTP-22 | CT-2 | CT-16 | 70/30 | 4,200 | B-2 | 130,000 |

TABLE 11

| Example: | Running limit value in H/H Fog occurred on: | Taber = volume loss | Photo-memory | Solvent cracking |
|---|---|---|---|---|
| 45 | 75,000th sheet. | 1.5 mg | 15 | Unseen. |
| 46 | 74,000th sheet. | 1.6 mg | 15 | Unseen. |
| 47 | 110,000th sheet. | 1.4 mg | 20 | Unseen. |
| 48 | 107,000th sheet. | 1.5 mg | 25 | Unseen. |
| 49 | 78,000th sheet. | 1.8 mg | 15 | Unseen. |
| 50 | 75,000th sheet. | 1.9 mg | 15 | Unseen. |
| 51 | 103,000th sheet. | 1.5 mg | 15 | Unseen. |
| 52 | 104,000th sheet. | 1.4 mg | 20 | Unseen. |

Here, the binder resin B-1 is a homopolymer having a repeating structural unit represented by the following Formula B-1.

(B-1)

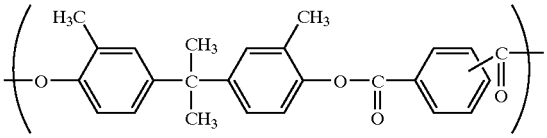

The binder resin B-2 is also a copolymer having a repeating structural unit represented by the following Formula B-2-1 and a repeating structural unit represented by the following Formula B-2-2.

(B-2-1)

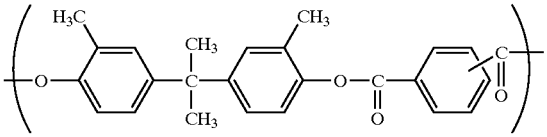

(B-2-2)

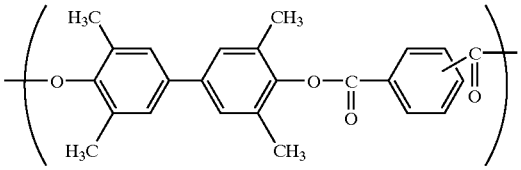

According to the present invention, the electrophotographic photosensitive member can be provided which has high surface mechanical strength, has superior durability (wear resistance or scratch resistance) and also has stability in repeated use, and the process cartridge and the electrophotographic apparatus which have such an electrophotographic photosensitive member.

What is claimed is:

1. An electrophotographic photosensitive member comprising a support, and provided thereon a photosensitive layer, wherein;

a surface layer of the electrophotographic photosensitive member contains:

an electrically insulating binder resin; and a random copolymer type high molecular weight charge transporting material having a repeating structural unit represented by the following Formula (11) and a repeating structural unit represented by the following Formula (12):

(11)

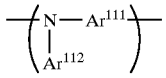

(12)

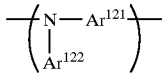

wherein $Ar^{111}$ and $Ar^{121}$ each independently represent a substituted or unsubstituted divalent aromatic hydrocarbon ring group other than a phenylene group, or a substituted or unsubstituted divalent aromatic heterocyclic ring group, and $Ar^{112}$ and $Ar^{122}$ each independently represent a substituted or unsubstituted monovalent aromatic hydrocarbon ring group or a substituted or unsubstituted monovalent aromatic heterocyclic ring group; provided that a case is excluded in which the repeating structural unit represented by Formula (11) and the repeating structural unit represented by Formula (12) are identical in structure; the random-copolymer type high-molecular-weight charge-transporting material having a weight-average molecular weight Mw of 1,500 to 9,000; and the random-copolymer type high-molecular-weight charge-transporting material formed by reacting two or more kinds of monomer materials simultaneously at the time of synthesis reaction for the copolymer.

2. The electrophotographic photosensitive member according to claim 1, wherein the Ar111 Formula (11) and the Ar121 in Formula (12) are each independently a divalent group having structure represented by one Formula selected from the group consisting of the following Formulas (21) to (26):

(21)

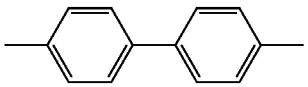

(22)

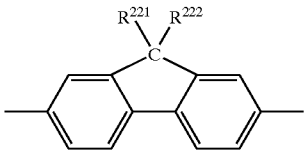

(23)

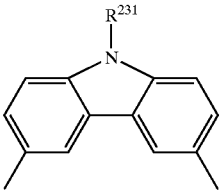

(24)

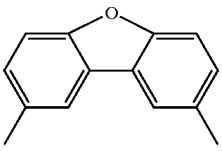

-continued (25)

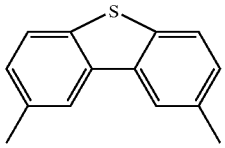

(26)

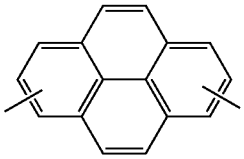

wherein, in Formula (22), R221 and R222 each independently represent a hydrogen atom, a substituted or unsubstituted alkyl group or a substituted or unsubstituted phenyl group; and, in Formula (23), R231 represents a substituted or unsubstituted alkyl group or a substituted or unsubstituted phenyl group.

3. The electrophotographic photosensitive member according to claim 1, wherein the Ar111 in Formula (11) is a divalent group having structure represented by the following Formula (21) and the Ar121 in Formula (12) is not a divalent group having structure represented by the following Formula (21):

(21)

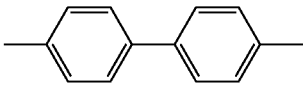

4. The electrophotographic photosensitive member according to claim 1, wherein the Ar111 in Formula (11) is a divalent group having structure represented by the following Formula (21) and the Ar121 in Formula (12) is a divalent group having structure represented by the following Formula (24) or (25):

(21)

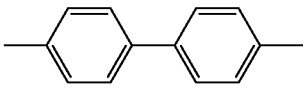

(24)

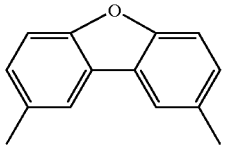

(25)

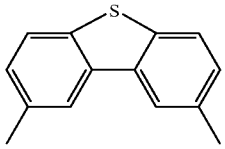

5. The electrophotographic photosensitive member according to claim 1, wherein the Ar111 in Formula (11) and the Ar121 in Formula (12) are divalent groups which are identical in structure, the Ar112 in Formula (11) and the Ar122 in Formula (12) are monovalent groups which are different in structure from each other, and at least one of Ar112 and Ar122 has an electron attractive group.

6. The electrophotographic photosensitive member according to claim 5, wherein the Ar111 in Formula (11) and the Ar121 in Formula (12) are divalent groups having structure represented by the following Formula (21):

(21)

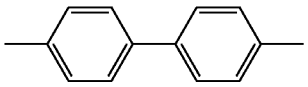

7. The electrophotographic photosensitive member according to claim 5, wherein, where in said random copolymer type high molecular weight charge transporting material the number of side chains having no electron attractive group is represented by B and the number of side chains having electron attractive groups by A, the value of B/A is in the range of from 2 to 40.

8. The electrophotographic photosensitive member according to claim 1, wherein, where the number of the repeating structural unit represented by Formula (11) said random copolymer type high molecular weight charge transporting material has is k, the number of the repeating structural unit represented by Formula (12) said random copolymer type high molecular weight charge transporting material has is m and the total number of repeating structural units said random copolymer type high molecular weight charge transporting material has is s, the value of (k +m)/s is in the range of from 0.5 to 1.

9. The electrophotographic photosensitive member according to claim 8, wherein, where the number of the repeating structural unit represented by Formula (11) said random copolymer type high molecular weight charge transporting material has is k, the number of the repeating structural unit represented by Formula (12) said random copolymer type high molecular weight charge transporting material has is m and the total number of repeating structural units said random copolymer type high molecular weight charge transporting material has is s, the value of (k +m)/s is in the range of from 0.75 to 1.

10. The electrophotographic photosensitive member according to claim 9, wherein, where the number of the repeating structural unit represented by Formula (11) said random copolymer type high molecular weight charge transporting material has is k, the number of the repeating structural unit represented by Formula (12) said random copolymer type high molecular weight charge transporting material has is m and the total number of repeating structural units said random copolymer type high molecular weight charge transporting material has is s, the value of (k +m)/s is 1.

11. The electrophotographic photosensitive member according to claim 1, wherein, where the number of the repeating structural unit represented by Formula (11) is k and the number of the repeating structural unit represented by Formula (12) is m, the value of k/m is in the range of from 1 to 30.

12. The electrophotographic photosensitive member according to claim 1, wherein said random copolymer type high molecular weight charge transporting material has a weight average molecular weight Mw of 5,000 or less.

13. The electrophotographic photosensitive member according to claim 12, wherein said random copolymer type high molecular weight charge transporting material has a weight average molecular weight Mw of 3,000 or less.

14. The electrophotographic photosensitive member according to claim 1, wherein said photosensitive layer has a charge generation layer containing a charge generating material and a charge transport layer containing said random copolymer type high molecular weight charge transporting material, and said surface layer is the charge transport layer.

15. A process cartridge comprising an electrophotographic photosensitive member having a photosensitive layer on a support, and at least one means selected from the group consisting of a charging means, a developing means, a transfer means and a cleaning means which are integrally supported; and being detachably mountable to the main body of an electrophotographic apparatus; wherein;

a surface layer of said electrophotographic photosensitive member contains:

an electrically insulating binder resin; and a random copolymer type high molecular weight charge transporting material having a repeating structural unit represented by the following Formula (11) and a repeating structural unit represented by the following Formula (12):

(11)

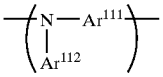

(12)

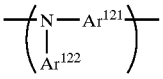

wherein $Ar^{111}$ and $Ar^{121}$ each independently represent a substituted or unsubstituted divalent aromatic hydrocarbon ring group other than a phenylene group, or a substituted or unsubstituted divalent aromatic heterocyclic ring group, and Ar112 and Ar122 each independently represent a substituted or unsubstituted monovalent aromatic hydrocarbon ring group or a substituted or unsubstituted monovalent aromatic heterocyclic ring group; provided that a case is excluded in which the repeating structural unit represented by Formula (11) and the repeating structural unit represented by Formula (12) are identical in structure; the random-corpolymer type high-molecular-weight charge-transporting material having a weight-average molecular weight Mw of 1,500 to 9,000; and the random-copolymer type high-molecular-weight charge-transporting material formed by reacting two or more kinds of monomer materials simultaneously at the time of synthesis reaction for the copolymer.

16. An electrophotographic apparatus comprising an electrophotographic photosensitive member having a photosensitive layer on a support, a charging means, an exposure means, a developing means and a transfer means, wherein;

a surface layer of said electrophotographic photosensitive member contains:

an electrically insulating binder resin; and a random copolymer type high molecular weight charge transporting material having a repeating structural unit represented by the following Formula (11) and a repeating structural unit represented by the following Formula (12):

(11)

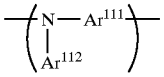

(12)

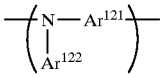

wherein $Ar^{111}$ and $Ar^{121}$ each independently represent a substituted or unsubstituted divalent aromatic hydrocarbon ring group other than a phenylene group, or a substituted or unsubstituted divalent aromatic heterocyclic ring group, and $Ar^{112}$ and Ar122 each independently represent a substituted or unsubstituted monovalent aromatic hydrocarbon ring group or a substituted or unsubstituted monovalent aromatic heterocyclic ring group; provided that a case is excluded in which the repeating structural unit represented by Formula (11) and the repeating structural unit represented by Formula (12) are identical in structure ; the random-copolymer type high-molecular-weight charge-transporting material having a weight-average molecular weight Mw of 1,500 to 9,000; and the random-copolymer type high-molecular-weight charge-transporting material formed by reacting two or more kinds of monomer materials simultaneously at the time of synthesis reaction for the copolymer.

* * * * *

UNITED STATES PATENT AND TRADEMARK OFFICE

CERTIFICATE OF CORRECTION

PATENT NO. : 7,001,699 B2
APPLICATION NO. : 10/647205
DATED : February 21, 2006
INVENTOR(S) : Takakazu Tanaka et al.

It is certified that error appears in the above-identified patent and that said Letters Patent is hereby corrected as shown below:

COLUMN 5:

Line 67, “aiyloxyl” should read --aryloxyl--.

COLUMN 6:

Lines 6-10 should be deleted.

COLUMN 30:

line 66, “htane” should read --thane--.

COLUMN 31:

Line 23, “runned up,” should read --ran out,--.

COLUMN 36:

Line 66, “random copolymer” should read --random-copolymer-- and “high molecular weight charge” should read --high-molecular-weight charge--.

COLUMN 37:

Line 35, “Ar 111 Formula” should read --$Ar^{111}$ in Formula--; and
Line 36, “Ar121” should read --$Ar^{121}$--.

COLUMN 38:

Line 17, “R221 and R222” should read --$R^{221}$ and $R^{222}$--;
Line 20, “R231” should read --$R^{231}$--;
Line 24, “Ar111” should read --$Ar^{111}$--;
Line 26, “Ar121” should read --$Ar^{121}$--;
Line 37, “Ar111” should read --$Ar^{111}$--;
Line 39, “Ar121” should read --$Ar^{121}$--;
Line 64, “Ar111” should read --$Ar^{111}$--;
Line 65, “Ar121” should read --$Ar^{121}$--;
Line 66, “Ar112” should read --$Ar^{112}$--; and
Line 67, “Ar122” should read --$Ar^{122}$--.

UNITED STATES PATENT AND TRADEMARK OFFICE

CERTIFICATE OF CORRECTION

PATENT NO. : 7,001,699 B2
APPLICATION NO. : 10/647205
DATED : February 21, 2006
INVENTOR(S) : Takakazu Tanaka et al.

It is certified that error appears in the above-identified patent and that said Letters Patent is hereby corrected as shown below:

COLUMN 39:

Line 2, "Ar112 and Ar122" should read --$Ar^{112}$ and $Ar^{122}$--;
Line 4, "Ar111" should read --$Ar^{111}$--;
Line 5, "Ar121" should read --$Ar^{121}$--;
Line 16, "where" should be deleted and "random copoly-" should read --random-copoly- --;
Line 17, "high molecular weight charge transporting" should read --high-molecular-weight charge-transporting--;
Line 25, "random copolymer" should read --random-copolymer-- and "high molecular weight charge trans-" should read --high-molecular-weight charge-trans- --;
Line 27, "random" should read ---random- -;
Line 28, "high molecular weight charge transporting" should read --high-molecular-weight charge-transporting--;
Line 30, "random copolymer" should read --random-copolymer-- and "high molecular weight" should read --high-molecular-weight--;
Line 31, "charge transporting" should read --charge-transporting--;
Line 37, "random copolymer" should read --random-copolymer-- and "high molecular weight charge trans-" should read --high-molecular-weight charge-trans- --;
Line 39, "random " should read --random- --;
Line 40, "high molecular weight charge transporting" should read --high-molecular-weight charge-transporting--;
Line 42, "random copolymer" should read --random-copolymer-- and "high molecular weight" should read --high-molecular-weight--;
Line 43, "charge transporting" should read --charge-transporting--;
Line 49, "random copolymer" should read --random-copolymer-- and "high molecular weight charge trans-" should read --high-molecular-weight charge-trans- --;
Line 51, "random " should read --random- --;
Line 52, "high molecular weight charge transporting" should read --high-molecular-weight charge-transporting--;
Line 54, "random copolymer" should read --random-copolymer-- and "high molecular weight" should read --high-molecular-weight--;
Line 55, "charge transporting" should read --charge-transporting--;
Line 65, "random-copolymer" should read --random-copolymer--;
Line 66, "high molecular weight charge transporting" should read --high-molecular-weight charge-transporting--; and
Line 67, "weight average" should read --weight-average--.

UNITED STATES PATENT AND TRADEMARK OFFICE

CERTIFICATE OF CORRECTION

PATENT NO. : 7,001,699 B2
APPLICATION NO. : 10/647205
DATED : February 21, 2006
INVENTOR(S) : Takakazu Tanaka et al.

It is certified that error appears in the above-identified patent and that said Letters Patent is hereby corrected as shown below:

COLUMN 40:

Line 2, "random-copolymer" should read --random-copolymer--;
Line 3, "high molecular weight charge transporting" should read --high-molecular-weight charge-transporting--;
Line 4, "weight average" should read --weight-average--;
Line 8, "random " should read ---random- --;
Line 9, "high molecular weight charge transporting" should read --high-molecular-weight charge-transporting--;
Line 18, "apparatus; wherein;" should read --apparatus, wherein--;
Line 23, "random copolymer" should read --random-copolymer-- and "high molecular weight charge" should read --high-molecular-weight-charge--.
Line 43, "Ar112 and Ar 122" should read --$Ar^{112}$ and $Ar^{122}$--;
Line 50, "random-corpolymer" should read --random-copolymer--; and
Line 65, "random copolymer" should read --random-copolymer-- and "high molecular weight charge" should read --high-molecular-weight-charge--

COLUMN 42:

Line 2, "Ar122" should read --$Ar^{122}$--; and
Line 8, "structure ;" should read --structure;--.

Signed and Sealed this

Eighth Day of August, 2006

JON W. DUDAS
*Director of the United States Patent and Trademark Office*